United States Patent [19]

Turnbull

[11] 4,086,879

[45] May 2, 1978

[54] ROTARY ENGINE WITH REVOLVING AND OSCILLATING PISTONS

[76] Inventor: Paul J. Turnbull, 2681 Kelly St., Hayward, Calif. 94541

[21] Appl. No.: 771,623

[22] Filed: Feb. 24, 1977

[51] Int. Cl.[2] ..... F02B 53/00

[52] U.S. Cl. ..... 123/216; 123/245; 418/34

[58] Field of Search ..... 123/8.47; 418/33, 34, 418/35

[56] References Cited

U.S. PATENT DOCUMENTS

| | | | |
|---|---|---|---|
| 1,353,205 | 9/1920 | Woodward | 418/34 UX |
| 1,458,641 | 6/1923 | Cizek | 418/34 X |
| 1,829,391 | 10/1931 | Bullington | 418/35 X |
| 2,631,545 | 3/1953 | Jones | 418/34 |
| 3,347,214 | 10/1967 | Plagmann | 418/35 |
| 3,899,269 | 8/1975 | Diamond | 418/35 |

*Primary Examiner*—Carlton R. Croyle
*Assistant Examiner*—Michael Koczo, Jr.
*Attorney, Agent, or Firm*—William R. Piper

[57] ABSTRACT

A rotary engine with complemental cylindrical rotors facing each other and rotatable about a common shaft. Each rotor has an annular recess with a pair of diametrically opposed pistons mounted therein, the pistons having their outer ends projecting beyond the recess and being oscillatably receivable in the annular recess of the adjacent rotor. Novel means is used for causing the four pistons to form four chambers between pairs of adjacent pistons, the pistons while rotating about the shaft being caused to oscillate with respect to each other so that for each revolution of the shaft, each of the four chambers will be successively enlarged for the "intake stroke" to receive a combustible gas, then contracted for the "compression stroke" in compressing the gas, then the compressed gas will be ignited for the "power stroke" causing the chamber to be enlarged and the power from the exploding gas being directed against the walls of the pair of pistons for rotating the shaft and finally the contracting of the chamber for exhausting the burnt gases.

12 Claims, 26 Drawing Figures

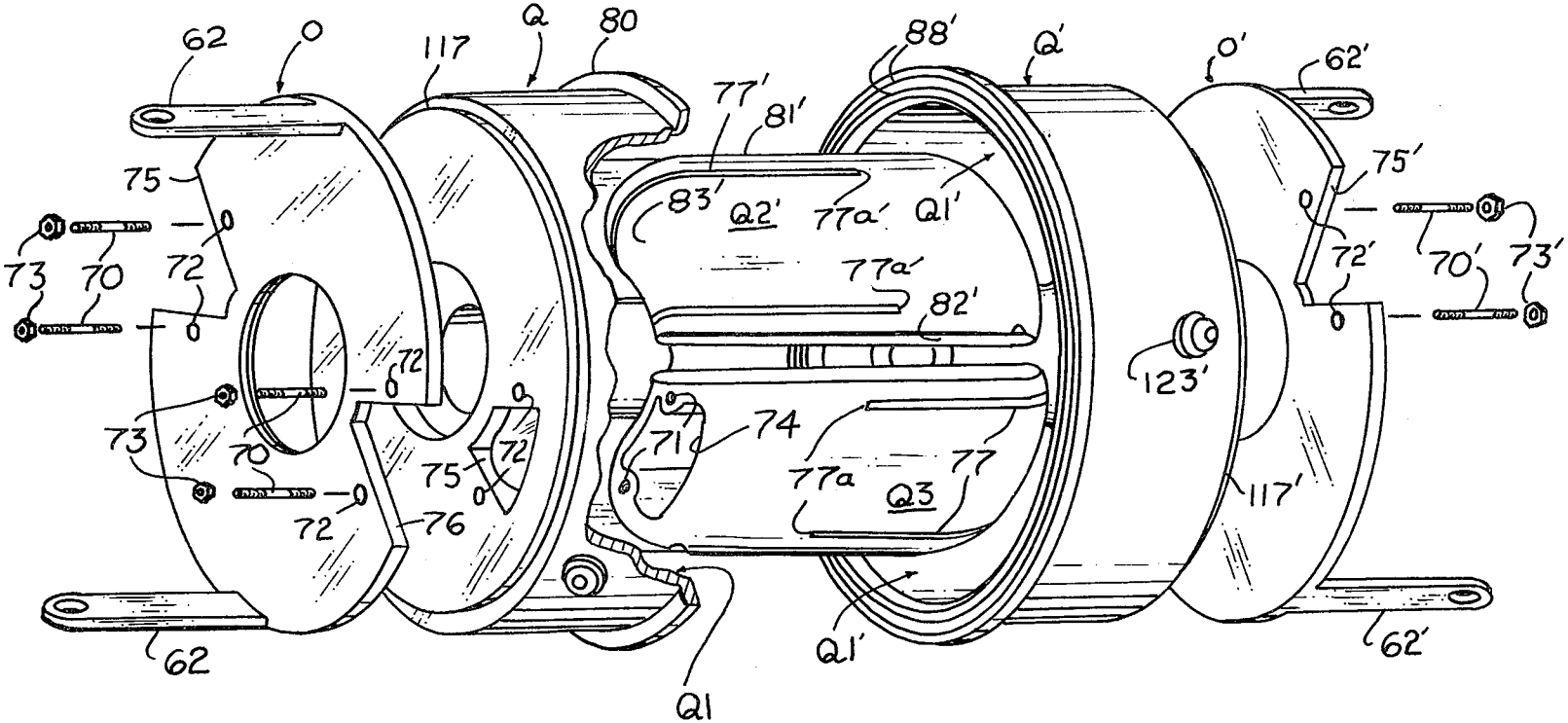
FIG. 6-A.

ROTARY ENGINE WITH REVOLVING AND OSCILLATING PISTONS

SUMMARY OF THE INVENTION

This rotary engine is an improvement over my patented rotary engine, U.S. Pat. No. 3,505,981, issued Apr. 14, 1970.

An object of my present invention is to provide a rotary engine which could also function as a fluid pump or a fluid driven motor. The present rotary engine has a unique sealing means between the adjacent moving parts. The combustion control in the engine is such that it has high efficiency with a low pollution from the exhaust gases.

A further object of my invention is to provide a rotary engine having a unique cooling system and a simple, safe, but effective ignition system.

BRIEF DESCRIPTION OF THE DRAWINGS

FIG. 4A is an exploded view of some of the parts of FIG. 4.

FIGS. 5A and 5B are sections taken along the lines 5A—5A and 5B—5B of FIG. 5.

FIG. 6A is an exploded perspective view of the piston rotors and associate parts.

DESCRIPTION OF THE PREFERRED EMBODIMENT

Figure 1:
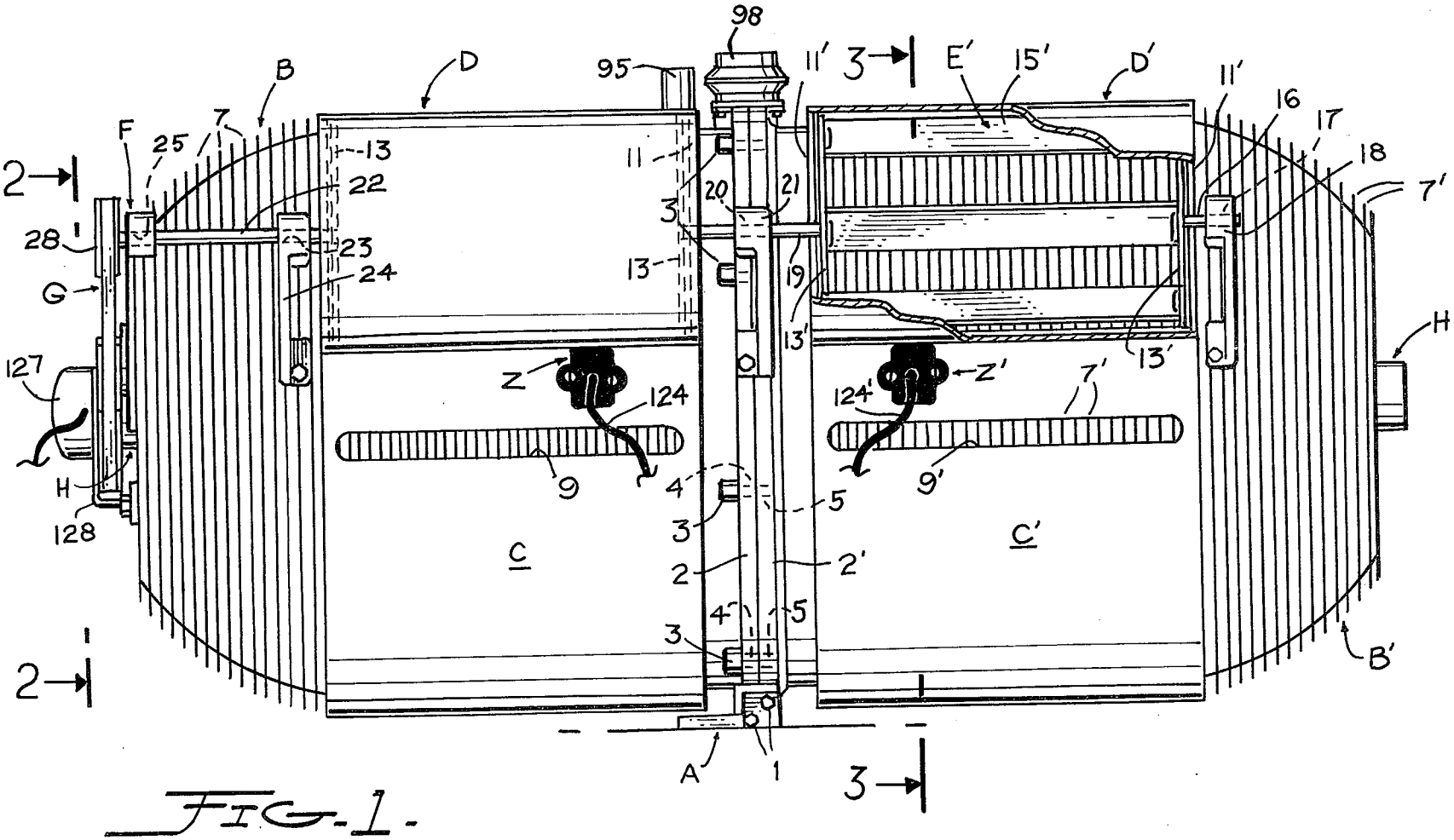
FIG. 1 is an external longitudinal view of the left side of the rotary engine, oriented looking forward from the power connection end. A break-away view of the fan housing shows the fan blade structure.

In carrying out my invention, I provide a motor mount A, which is secured by cap screws 1 tightened into threaded holes of flanges 2 and 2', see FIG. 1. Hereafter, I will prime the letters and numbers for designating parts on the rear half of the engine that have essentially identical parts to that of the front half of the engine. It should be noted that any part with a primed number or letter will have a matching part with an unprimed number or letter.

Figure 6:
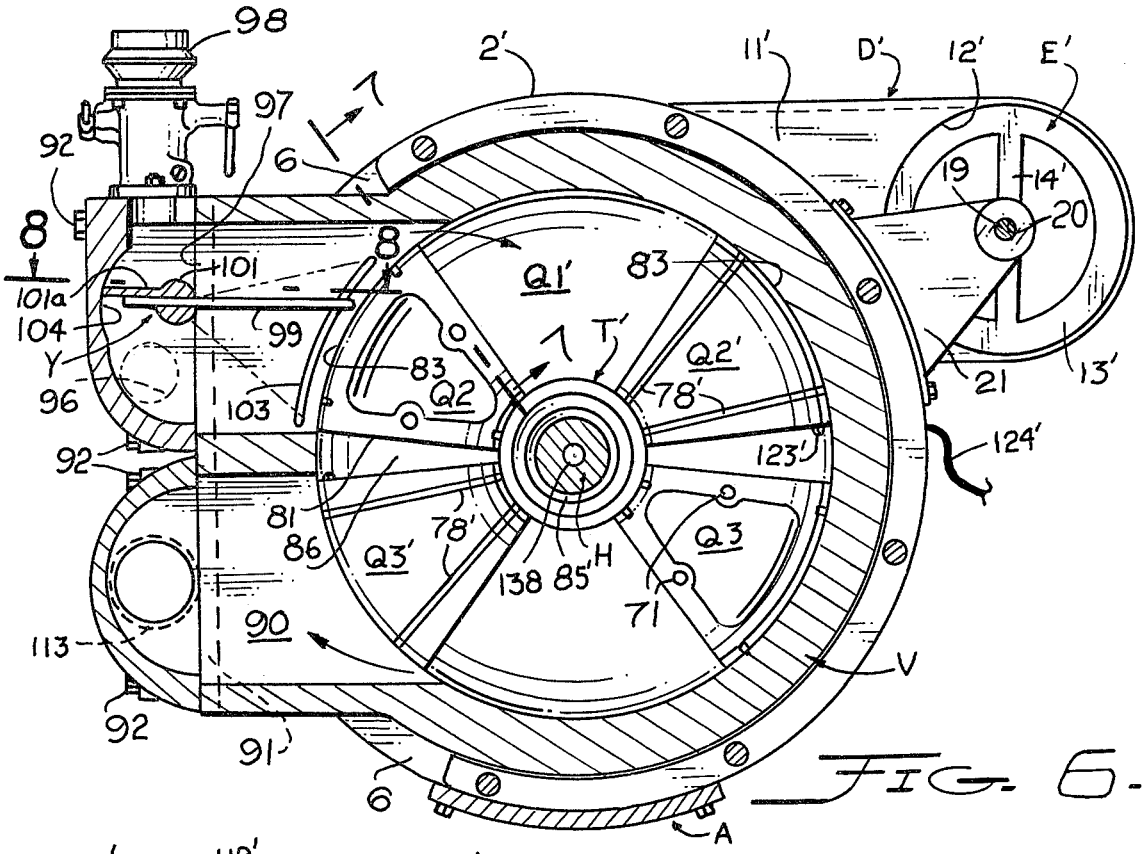
FIG. 6 is a transverse section taken along line 6—6 of FIG. 4.

FIG. 1 shows the flanges 2 and 2' as parts of front and rear finned housing B and B' that have mating edges lying perpendicular to the axis of the engine. Cap screws 3 extend through holes 4 in the flange 2 and are tightened into threaded holes 5 in the flange 2'. Referring now to FIG. 6, the mating surfaces of the flanges 2 and 2' do not encircle the engine housing completely, but form an opening 6 on the right side of the engine to provide a clearance for the laterally projecting part of the port housing V.

Figure 2:
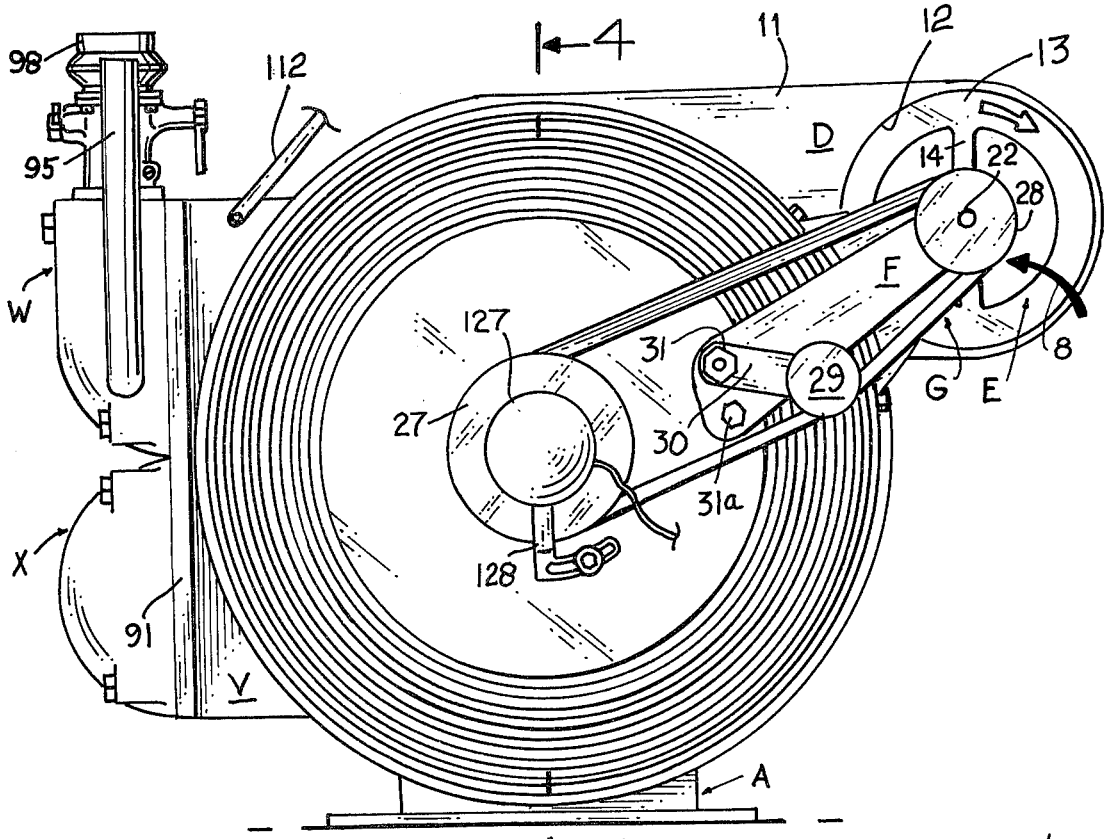
FIG. 2 is an external front view of the rotary engine when looking in the direction of the arrows 2—2 in FIG. 1.
Figure 3:
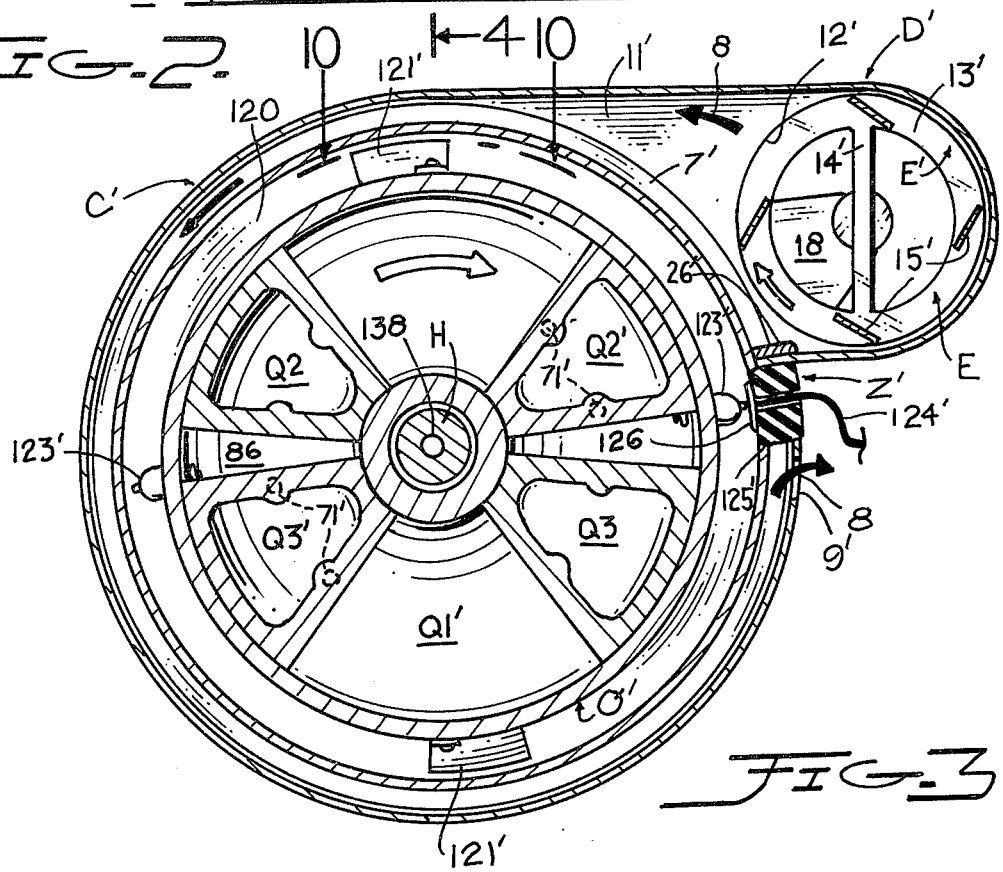
FIG. 3 is a transverse section taken along line 3—3 of FIG. 1
Figure 4:
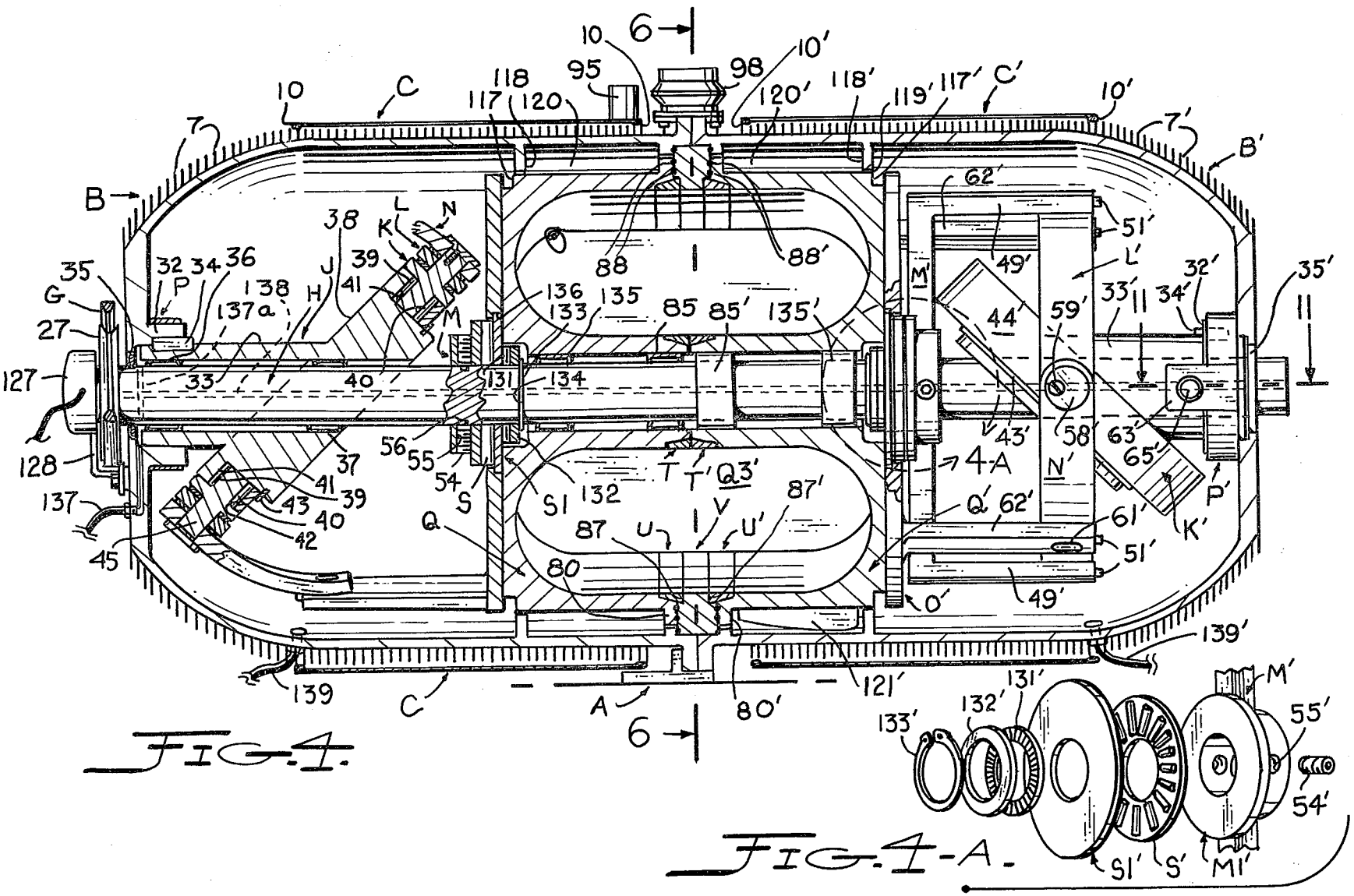
FIG. 4 is a longitudinal section taken along line 4—4 of FIG. 2.

Two shrouds C and C' wrap closely around fins 7 and 7' of the housings B and B', see FIGS. 3 and 4. This encourages forced air in the direction as indicated by arrows 8, to flow between the fins 7 and 7' and around the interior of the housings B and B' and out through the exit holes 9 and 9', see FIG. 1 and FIG. 3. Referring to FIG. 4, the shrouds are supported and sealed additionally by resilient spacers 10 and 10', which are mounted between the tops of the fins and the ends of the shrouds. Each spacer encircles completely the tops of the two sets of fins on the cylindrical portions of the finned housings B and B'. The fins 7 and 7' are shown by single lines in most of the Figures. FIGS. 1, 2 and 3 show extended portions of the shrouds C and C', which function as fan housings D and D' on the left hand side of the engine. The fan housings extend laterally from the engine housing and terminate in hollow semi-cylindrical portions extending along the top side of the engine. Cover plates 11 and 11' seal in the front and rear parts of the fan housings D and D', respectively, with the exception of four clearance holes 12 and 12' for the fans E and E', see FIGS. 1 and 3. The two fans are mounted within the two housings D and D', see FIGS. 2 and 3. The fan E' consists of two end plates 13' with circular openings in their centers and with an integral member 14' extending diametrically across each opening. Fan blades 15' are suitably attached on the inside faces of the plates. The fan E is identical in construction to the fan E'. The rear plate 13' of the rear fan E' has a short shaft 16 affixed on the center of rearwards facing cross member 14', see FIG. 1. The shaft 16 extends rearwardly and is rotatably mounted in a bearing bore 17 of a bracket 18.

A short shaft 19 is affixed to the forward facing center of the other cross member 14' and extends forwardly and through a bearing bore 20 in the bracket 21 mounted at the center of the engine, see FIG. 1. The shaft 19 extending forward of the bracket 21 is affixed to the center of the cross member 14 of the other fan E. A longer shaft 22 is affixed to the forward side of the other cross member 14 near the front of the engine. The shaft 22 extends forwardly through bearing bore 23 in a bracket 24 and through a bearing bore 25 in a bracket F mounted on the front of the engine.

Referring again to FIG. 3 the fan blades 15' are inclined against the air, when spinning in a clockwise motion. Air is drawn through the ends of the fans and into the center area of the fan blades and is forced outwardly through the blades and around the fins. Flaps 26 and 26' prevent a reverse flow of air through the fins 7 and 7'. These flaps are mounted at the bottoms of the fan housings E and E'. The flaps are affixed by suitable means to the bottoms of the fan housings.

FIG. 2 shows a belt G which is driven by a large pulley 27 suitably attached to a main shaft W which is the power source, see FIG. 1. The belt G engages a fan pulley 28 which is suitably attached to the shaft 22 turning the fans E and E'. The lower reach of the belt G engages an idler pulley 29 which is used for adjusting the tension of the belt G. The pulley 29 is rotatably mounted to an adjusting arm 30. The arm 30 is held in adjusted position by a cap screw 31. The cap screw 31 along with another cap screw 31A mount the bracket F to the front of the engine.

Referring to FIG. 4, the main shaft W extends entirely through the center of the engine. A hollow cylindrical shield 32 extends from the inside front wall of the housing B, and encircles the end of a hollow sleeve 33 which in turn extends rearwardly and is an integral part of an inclined stator J. A key 34 is placed between the hollow shield 32 and the hollow sleeve 33 and is received within the slots of each for preventing rotational movement of the inclined stator J. A seal 35 is pressed into the front of housing B and it encircles the main shaft W and slidably engages the shaft to prevent oil leakage. At the rearward part of the seal 35 I provide a needle bearing 36 which is mounted inside of hollow sleeve 33 and encircles the main shaft W. There is another needle bearing 37 between the rearward part of the inclined stator and this bearing encircles the shaft.

Figure 5:
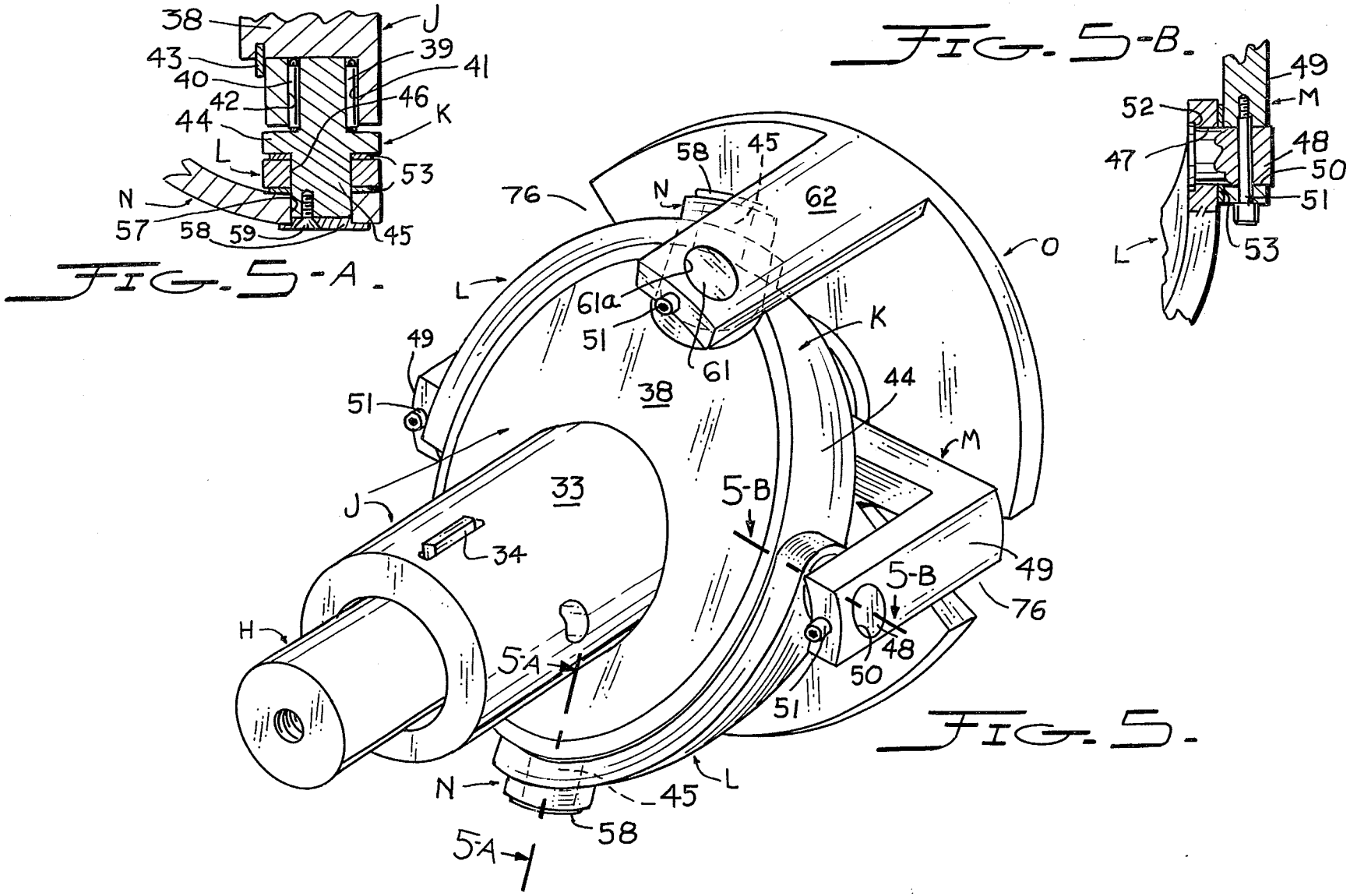
FIG. 5 is an external isometric enlarged view of the drive mechanism.

An inclined disc 38 of the stator J is positioned at a predetermined angle to the longitudinal axis of the engine, see FIGS. 4 and 5. The angle shown in 45° but the engine is not necessarily limited to a 45° angle and could be designed with other angles. Rotatably encircling the rim of the disc 38 of the stator J is a rotor K that has an inwardly extending annular flange which is sandwiched in between thrust needle bearings 39 and 40, see FIG. 5A. The uppermost needle bearing 39 bears against an annular flange 41 of the stator J and the lowermost needle bearing 40 bears against a thrust ring 42 which is held in place by a split ring 43 that encircles the inclined disc 38. On the rotor K just outward of, and encircling the integral flange 41 and thrust ring 42 and cylindrically enclosing the rim of the disc 38 is a flange 44. On the rotor K are two rotor journals 45 which are suitably attached to, or integral with the rotor K. The rotor journals 45 extend radially from the rotor K and are disposed diametrically opposite each other. Each of the two rotor journals is spaced exactly the same distance from the axis of the engine.

Two arcuate shaped transfer rods L, which extend substantially through arcs of 90°, have one of their ends connected to the journals 45, see FIG. 4 and FIGS. 5 and 5A. A bearing bore 46 in the transfer rod L pivotally receives the rotor journal 45. A bearing bore 47 in the other end of the transfer rod L, see FIG. 5B, pivotally receives a shaft journal 48 mounted on an extension arm 49 of a shaft coupling M, see also FIG. 5. One end of the transfer rod L subtends 90° from the center of the bearing bore 46 to the center of the bearing bore 47. The arcuate edges of the transfer rod L are always essentially concentric with the axis of the engine at a point exactly between the rotor journals, see the schematic FIGS. 14A, 14B, 15A and 15B. These Figures will be described more fully later on when setting forth the operation of the engine and when describing the schematic view of the entire rotary engine shown in FIG. 22.

The rotor journal 45, the arcuate transfer rod L, the shaft journal 48 and the extension arm 49 of the shaft coupling M, each have corresponding members mounted diametrically opposite and cooperating therewith to perform the function of transferring the exact rotational motion of the rotor K to the main shaft H. In addition, the diametrically paired members provide increased dynamic capacity as well as balance. The rotational movement will be capable of originating at the shaft W through the shaft coupling M for purposes of starting the engine.

The shaft journal 48 is received in a hole 50 of the extension arm 49 for the shaft coupling M, see FIGS. 5 and 5B. The shaft journal 48 is secured in the arm by the means of a shoulder screw 51 extending through both the extension arm 49 and the journal 48. FIG. 5B shows a shoulder 52 on the journal 48 which retains the arcuate transfer rod L pivotally in the bearing bore 47. A standard washer 53 encircles the journal 48 between the extension arm 49 and the transfer rod L providing clearance between these cooperating parts and taking up wear. Similar washers 53 encircle the rotor journal 45, see FIG. 5A, and perform identical functions between the rotor K and the transfer rod L and between the transfer rod and a change rod N, see FIGS. 5A and 5B. Referring to FIG. 4, I provide two dog point set screws 54 which are received in diametrically opposite tapped holes 55 provided in the shaft coupler M. The ends of the set screws are received in two recesses 56 in the main shaft W. This arrangement causes both of the main shaft W and the shaft coupler M to rotate in unison.

Referring again to FIGS. 4 and 5, it should be noted that the following described parts will have diametrically opposite similar parts cooperating in exactly the same way. A bearing bore 57, see FIG. 5A, in a change rod N pivotally receives the rotor journal 45. A cap 58 prevents the change rod N from slipping off from the rotor journal 45. A screw 59, positioned off center, to prevent loosening by the pivoting of the bore 57 on the journal 45, holds the cap to the journal. The change rod N is arcuate in shape with radiuses of the inner and outer curves essentially concentric with a point midway exactly between the rotor journals 45, see the schematic showing in FIG. 22 where the arcuate-shaped change rods N, are represented by arcuate lines. The other end of the change rod N, see FIG. 12B, has a bearing bore 60 pivotally receiving an angular change journal 61 of a rotor plate extension arm 62 of a rotor plate O. The journal is received in a hole 61A of the extension arm 62. From the center of the bearing bore 57 to the center of the bearing bore 60 subtends a predetermined angle which is slightly more than 45°, but is not necessarily limited to this as other combinations of angular dimensions could also be used, see the schematic showing of FIG. 12B. The coupling arrangement of the plate extension arm 62 to the angular change journal 61 is exactly the same as the shaft extension arm 49 to the shaft journal 48, see FIGS. 5 and 5B. The shoulder screw 51 in FIG. 5B, retains the shaft journal 48 with the washer 53 encircling the journal 48 between the plate extension arm 49 and the transfer rod N.

Figure 22:
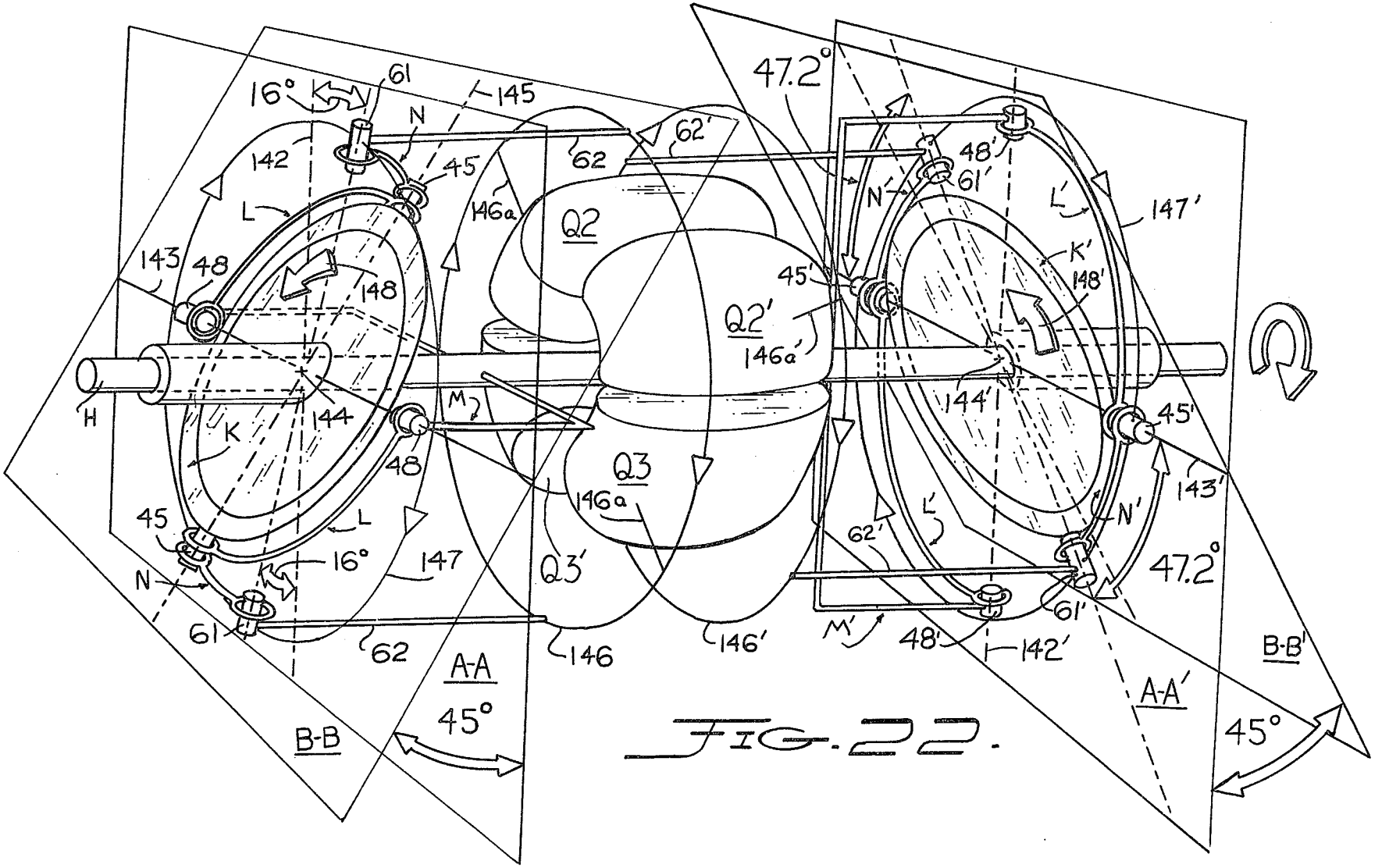
FIG. 22 is an oblique projection and schematic showing of the various parts of the engine.

Referring to FIG. 22, the rotor journals 45—45 are in substantially a vertical position and the change rods N—N, being of limited length, are pivoted in such a way because of the inclination of the rotor K, thereby causing the angular difference of the rotor journals 45 in relation to the change journals 61 to be at a minimum angle 129, see FIG. 12A (shown as 16° of angle on FIG. 22). Referring to shcematic FIG. 12B, which is a side view of the positions just described, it becomes apparent that should the rotor K move longitudinally at all in relation to the change journals 61, a binding effect would occur. The misalignment of the rotor K to the change journal 61 could occur through uneven thermal expansion of the relative parts. If the stator J were allowed to float longitudinally along the shaft H, vibration would be encouraged.

Figure 11:
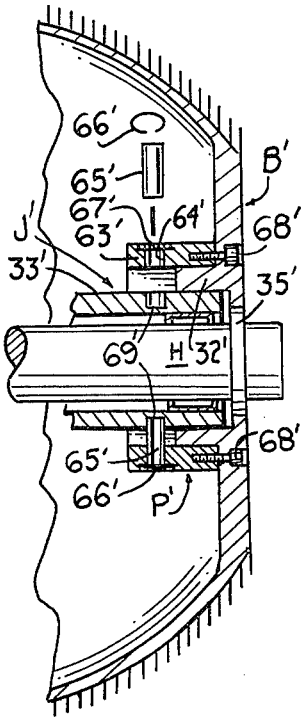
FIG. 11 is a longitudinal section of a part of the engine showing the bearing support for the main shaft and is taken along the line 11—11 of FIG. 4.

I provide novel means to keep the rotor K and change journals 61 aligned. Referring to FIGS. 4 and 11, cylindrical sleeves P and P' encircle the hollow sleeves 32 and 32' which are integral with the housings B and B'. Two longitudinal extensions of each sleeve, see the extensions 63' for the sleeve P' in FIG. 11; extend towards the engine center and have two diametrically opposed holes 64' which receive soft metal or lead pegs or pins 65. The pins 65 are retained by internal retaining rings 66' which are received in grooves 67'. In FIG. 11, I show the upper pin 65' removed from its hole 64' for purpose of clarity and further show the retaining ring 66' spaced above the pin 65'. Recessed cap screws 68' hold the sleeve P' to the housing B'. Holes 69' in the sleeve portion 33' of the stator J' receive the lead pins 65'. The lead pins 65' extend through an annular clearance between the extensions 63' and the integral sleeve portion 33' of the stator J allowing them to bend slightly from forces of the change rods N'. This automatically realigns the members and will serve as a dampener against vibration. An identical arrangement is at the front portion of the engine.

Referring to FIGS. 4, 6, 6A and 7, it will be seen that the rotor plates O and O' are shown contacting the ends of piston rotors Q and Q', respectively. Both piston rotors Q and Q' are rotatably mounted on the main shaft H, as is shown in FIG. 4. Then in the exploded perspective view of FIG. 6A, I omit the main shaft H and show the rotor plate O spaced from the piston rotor Q and show the rotor plate O' spaced from the piston rotor Q'. Also, in FIG. 6A, the front end of the engine is at the left side of the Figure while in FIG. 7 the front end of the engine is toward the right hand side of the Figure. I provide needle bearings 85 and 135 and 85' and 135' for the piston rotors Q and Q', respectively, see FIG. 4, and these bearings encircle the main shaft H, and are positioned at the inner bores of the piston rotors and substantially midway between the ends of the finned housing B—B'.

Figure 7:
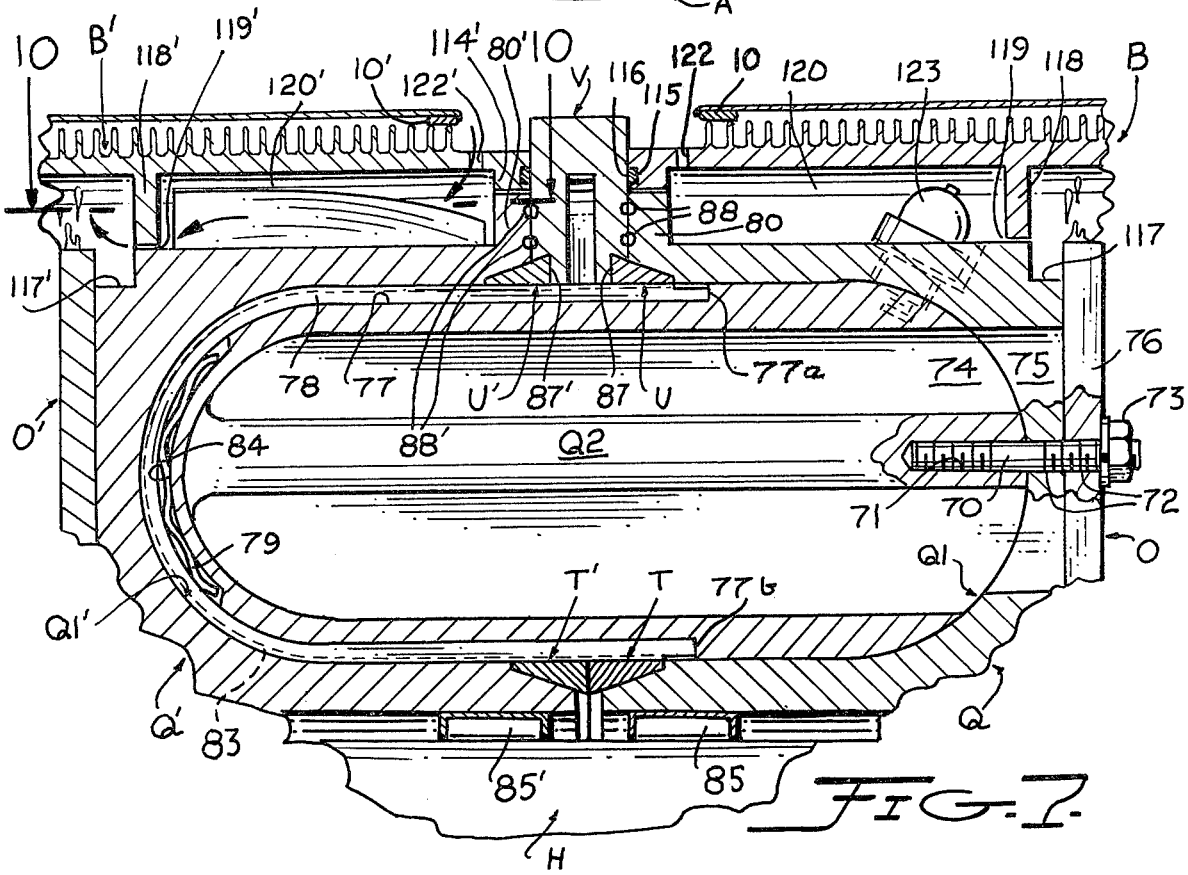
FIG. 7 is a section further illustrating a longitudinal portion of the engine and is taken along line 7—7 of FIG. 6.

If the two FIGS. 4 and 6A are compared, it will be seen that the two piston rotors Q and Q' face each other and are identical in structure. A more detailed description of both will now be given. It should be kept in mind that the piston rotor Q, is positioned nearer the front end of the engine and the piston rotor Q' is positioned nearer the rear end. The piston rotor Q' and its associate parts will have their letters and reference numerals primed and in this way they will be distinguishable from the letters and reference numerals of the piston rotor Q and its associate parts which are not primed. FIG. 7 shows the rotor plate O (the front of the engine is toward the right hand side in this Figure) secured to the piston rotor Q and to a piston Q2 by a stud 70 that extends through aligned holes 72 in the rotor plate O and the piston rotor Q and into a tapped recess 71 in the piston. The piston Q2 is hollow and has an exterior shape whose side walls 81 and 82 flare outwardly and lie in planes that extend radially from the longitudinal axis of the main shaft H, see FIG. 6. The outer periphery 83 of the piston Q2 is arcuate in shape with the center of the arc coinciding with the axis of the shaft H. The periphery 83 will have a sliding contact with the inner circular chamber wall or annular recess Q1 in the complimentary piston rotor Q', see also FIG. 6A. In addition, the longitudinal section through the piston Q2, as shown in FIG. 7, illustrates the arcuate periphery 83 as being semicircular. It is difficult to illustrate this particular shape of the piston. The perspective view of the piston Q2', FIG. 6A, which is a duplicate of the piston Q2, will give a general contour view of the piston.

Each piston rotor Q and Q' has an annular recess or rotor chamber wall Q1 and Q1', respectively, that encircles the main shaft H. Both FIGS. 6A and 7 illustrate the chamber walls Q1 and Q1' as having inner and outer parallel side walls interconnected by a semi-circular wall surface. Each chamber wall is therefore U-shaped in cross section with the open end of each annular recess or rotor chamber wall Q1 and Q1' facing the other one. FIGS. 6 and 6A show that each piston rotor Q and Q' has two pistons Q2, Q3 and Q2', Q3', respectively, of the type and shape already described. The two pistons Q2 and Q3 for the piston rotor Q, are spaced diametrically apart, see these two pistons shown in FIG. 6, and the inner ends of these two pistons are received in the rotor chamber wall Q1 and are secured in position by studs, while the outer ends of the two pistons extend into the annular chamber wall Q1' of the piston rotor Q' and are adapted to rotate in this chamber wall and about the longitudinal axis of the engine in a manner later to be described.

For the purpose of clarity, the piston Q3 in the exploded view of FIG. 6A is shown separated from its piston rotor Q, and in like manner the piston Q2' is shown spaced from its piston rotor Q'. Each piston is hollow and it has an opening in its base portion, see the opening 74 in the piston Q3 of FIG. 6A, and this opening 74 is aligned with an opening 75 in the base of the piston rotor Q, and with a recess 76 in the rotor plate O when the piston Q3, the piston rotor Q and the rotor plate O, are connected together by the studs 70 and the nuts 73. In FIG. 7, the front end of the engine is toward the right hand side of the Figure and the outer end of the piston Q2 is shown projecting into the annular chamber wall Q1' of the piston rotor Q'.

Each of the four identical pistons is provided with a pair of spaced apart expansion seal receiving grooves 77 that extend in a longitudinal direction along the outer surface of the piston, starting at a point **77*a* and following around the outer periphery 83 of the piston, see FIGS. 6A and 7, and thence along the inner surface of the piston in a longitudinal direction and ending at the point 77*b*. A horseshoe-shaped expansion seal 78** is positioned in each groove 77. The groove 77 is made deeper at 84, see FIG. 7, and a marcel booster spring 79 is placed in this deeper portion and yieldingly urges the adjacent portion of the seal 78 against the adjacent wall of the annular chamber Q1'. The two horseshoe-shaped seals 78 for each piston function in the same manner as piston rings do on a piston used in a reciprocating type engine.

The particular manner of assembling the two piston rotors Q and Q' on the main shaft W, and providing gas proof sealings between the two is illustrated in detail in FIGS. 4 and 7. The entire assembly is shown in FIG. 4 while only one-half portion on an enlarged scale is illustrated in FIG. 7. The two piston rotors Q and Q' face each other and they are connected to their rotor plates O and O' by the studs 70 in the manner already described. The shaft couplings M and M' which connect the variable ratio functioning of rotors K and K' to shaft W are mounted on the shaft W, and are clearly shown in FIG. 4.

The shaft coupling M is positioned at the front of the engine. The other shaft coupling M' is positioned at the rear of the engine. Both encircle the main shaft W. Rotor Q and Q' are positioned between the shaft couplings encircling the central part of main shaft H. Couplings M and M' are identical. A description of the forward shaft coupling M will suffice to describe both. The central part of shaft coupling M encircles the main shaft H and has two arcuate surfaces concentric to the axis of the engine and are disposed on opposite sides of the shaft. Midway on each arcuate surface are drilled and tapped holes 55—55 which receive two dog-point set screws 54—54. The set screws tighten into holes 55—55 with the points extending tightly into recesses 56—56 of the main shaft H. The recesses are radial to the axis of the engine and the recesses 56—56 to the front of the engine are perpendicular to those recesses 56'—56' at the rear part of the engine. This may be described additionally by saying the front recesses are disposed 90° further around in a clockwise direction on the shaft from the position occupied on the shaft by the rear pair. See also the schematic FIG. 22. Dividing the arcuate surfaces of coupling M are two radial projections, square in cross section. These radial projections are integral with the two extension arms 49—49 which are parallel to each other and are equidistant to the axis of the engine. These arms extend forward and will be described more fully later on.

The central part of the shaft coupling M has an integral thrust race M1 disposed perpendicularly to, and encircling the shaft facing toward the center of the engine, See FIGS. 4 and 4A. The race surface bears against the thrust bearing S encircling the shaft H. The other side of the thrust bearing S bears against the race surface of a disc S1. The outer edge of disc S1 fits in a groove 136 of the rotor plate O and is held securely against the rotor Q. The opposite face of the disc S1 disposed more inwardly along the shaft from bearing S, forms a thrust race for the thrust bearing 131 encircling the main shaft. The thrust bearing 131 bears against the thrust washer 132 which is prevented from longitudinal movement along the shaft by a split retaining ring 133 which is held by spring tension in the groove 134 of the main shaft H. The disc S1 is held securely on the rotor Q, and the rotor Q by this means is prevented from longitudinal movement along the shaft by bearings S and 131. This arrangement which is exactly the same to the rear of the engine locates each rotor at exact positions along the main shaft H and thus enable close clearances to be held between the rotors and their respective rotor pistons. The close proximity of the bearings S and 131 and S' and 131' help alleviate stresses on the bearings which could be caused by thermal expansion. The radial loadings of the rotor Q and the rotor Q' are carried by the radial needle bearings 135, 85 and 135', 85', respectively, which are between the piston rotors Q and Q' and the shaft H, which they encircle.

Both FIGS. 4 and 7, further show the inner ends of the piston rotors Q and Q' with an annular outer flange 80 and 80', respectively. The needle bearings 85 and 85' rotatably support the inner ends of the piston rotors Q and Q'. It will further be seen from FIGS. 4 and 7 that the adjacent inner ends of the piston rotors Q and Q' have wedge-shaped grooves on their inner surfaces that receive sealing rings T, and T' that are also wedge-shaped in cross section and contact each other at their mating faces. Each sealing ring T and T' rotates exactly as their respective rotors to which they are connected by suitable means.

The annular outer flanges 80 and 80' of the piston rotors Q and Q', respectively, are spaced from each other and receive a ring-shaped port housing V, therebetween, see FIGS. 4, 6 and 7. This port housing encircling the four rotor pistons is adapted to be angularly rotated with respect to the drive mechanism for a purpose hereinafter described. The outer annular flanges 80 and 80' of the piston rotors Q and Q' abut the adjacent sides of the ring-shaped port housing V, and circular sealing spaces 88 and 88' are formed by complementary grooves provided in the adjacent faces and form labyrinth seals between the moving parts. In addition, the abutting portions of the annular outer flanges 80 and 80' with the ring-shaped port housing V have complementary annular grooves which receive circular sealing rings U and U' that are substantially wedge-shaped in cross section as clearly shown in FIGS. 4 and 7. The rings U and U' are attached to, by suitable means, and rotate with their respective rotors Q and Q'. It can be noted that both sealing rings, the outer ring U and the inner ring T rotate with the rotor Q, as do the rings U' and T' rotate with the rotor Q'. These rings are pressure activated and in this way are similar to compression rings of a conventional engine. This wedge-shaped configuration of the rings U and U' cause them to bear against their sealable surfaces on the piston rotors Q and Q' and port housing V when compression and combustion pressures are exerted on them. This condition is also true for the sealing rings T and T' whose vertical surfaces bear against each other, see FIG. 7, and diagonal surfaces bear against the rotors Q and Q'. These sealing pressures of the rings U and U' and the rings T and T' occur only through the sequence of compression and combustion during each revolution and have sufficient time to recover lubricant through the exhaust and intake strokes.

FIG. 3 is a transverse section taken along the line 3—3 of FIG. 1, through the rear half of the engine and looking toward the rear of the engine. The diametrically opposed pistons Q2 and Q3, which are rigidly secured to the piston rotor Q, are shown rotatably received in the annular recess Q1' of the adjacent piston rotor Q'. Also, the pistons Q2 and Q3 are shown in one of their relative positions with respect to the two diametrically opposed pistons Q2' and Q3' which are rigidly secured to the piston rotor Q', and are rotatably received in the annular recess Q1 of the piston rotor Q, not shown in FIG. 3. The piston Q3′ is shown spaced a slight distance away from the piston Q2 and the same position between the two pistons is also shown in FIG. 6. The two pistons Q2 and Q3′ when in this position have just completed their exhaust "stroke" for the restricted space 86 which lies between the two adjacent ends of the pistons during a portion of the clockwise rotation of the two pistons about the longitudinal axis of the rotary engine while it is operating.

It will be noted from FIG. 6 that when the restricted space 86 formed by the closeness of the two pistons Q2 and Q3′ and bounded by the annular recesses Q1 and Q1′ in the piston rotors Q and Q′, respectively, this restricted space has just moved past an exhaust port 90 in the port housing V, and is about to pass by an intake port 97. Therefore, before describing the novel relative movements between the pistons Q2 and Q3 which are carried by the piston rotor Q, and the pistons Q2′ and Q3′ that are carried by the piston rotor Q′, it is best to describe the structure for feeding a combustible gas through the intake port 97 and into the space or moving compartment 86 and for the exhaust port 90 to receive the exhaust gases from the same moving compartment 86 after it has traveled around the longitudinal axis of the rotary engine through almost a complete 360°. During this movement of the compartment 86, I will show how it is continuously enlarged as it passes the intake port 97 for receiving the combustible gas and this is likened to the intake stroke of a four cycle internal combustion engine. Then the moving compartment 86 will start to contract due to the novel movement of the pistons Q2 and Q3′ and this will correspond to the compression stroke and at the proper time a spark plug will ignite the gas, causing the exploding gas to move the pistons for enlarging the compartment 86, which corresponds to the firing stroke. This is followed by the pistons Q2 and Q3′ again restricting the capacity of the moving compartment 86 and forcing the exhaust gases into the exhaust port 90. The manner of moving the pistons Q2 and Q3′ in this novel way will be described after the following description of the intake and exhaust ports and how they can be moved through an arc for changing the positions of the intake and exhaust ports with respect to the moving compartment 86 as it passes these ports.

In FIGS. 4 and 6, I show the ring-shaped port housing V, as entirely encircling the main shaft H, and as being interposed between the adjacent ends of the piston rotors Q and Q′. Therefore, the intake port 97 and the exhaust port 90 will have direct access to the interiors of the annular recesses Q1 and Q1′ of the two piston rotors Q and Q′, respectively. The intake port will first be described and this will be followed by a description of the exhaust port.

Figure 8:
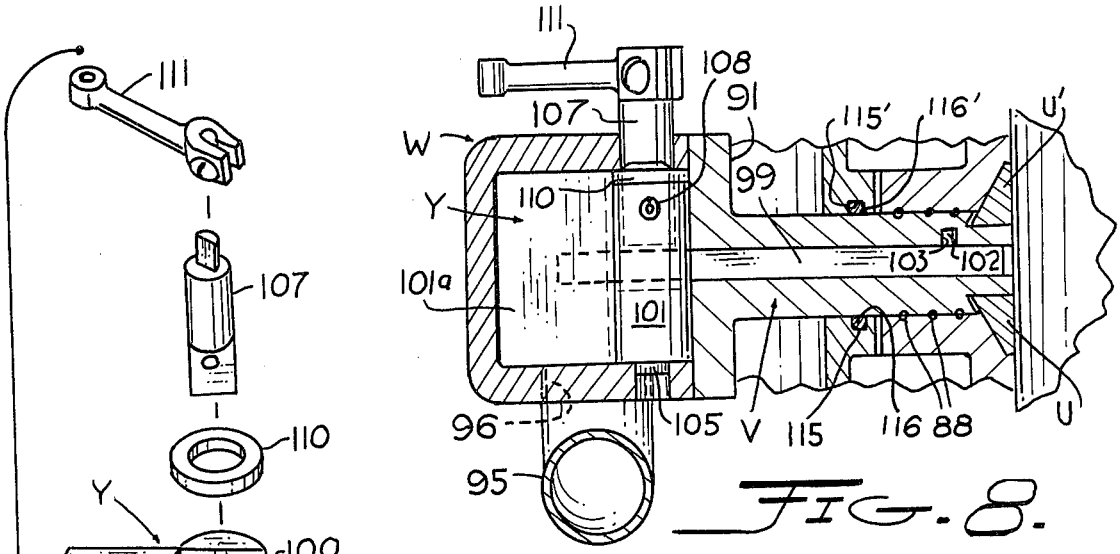
FIG. 8 is a section taken along the line 8—8 of FIG. 6 and illustrates a cross section of the intake port containing the meter vane.

An intake manifold W covers the intake port 97, see FIG. 6, and a carburetor 98 feeds a combustible mixture to the manifold and intake port. A horizontal section of the manifold and intake port is shown in FIG. 8 and it is taken along the line 8—8 of FIG. 6. Cap screws 92 secure the manifold W to the port housing V so that the combustible mixture from the carburetor can flow into the intake port 97. I provide novel means for adding a desired ratio of atmospheric air to the combustible mixture from the carburetor and for feeding this air into the enlarging movable compartment 86 that lies between the pistons Q2 and Q3′ just ahead of the gaseous mixture being fed so that the air will occupy the inner portion of the compartment and the combustible mixture will occupy the outer portion where it will be readily ignited when the compartment passes the spark plug and the spark therefrom will start the gas to instantly explode with the atmospheric air trapped in the inner port of the compartment feeding the exploding gas with additional oxygen for more complete burning of the gas and thus provide a more efficiently operating engine.

Both FIGS. 6 and 8 show the lower part of the intake manifold W provided with an air inlet opening 96 and an air inlet pipe 95 communicates with this opening. A more clear showing of the pipe 95 and the intake manifold W, is shown in the side elevation of the rotary engine shown in FIG. 16. The manner of controlling the ratio of atmospheric air to the explosive mixture from the carburetor 98 comprises an apparatus shown in FIGS. 6 and 8 and the exploded view of FIG. 9. A separator device, indicated generally at Y, in FIG. 6, includes a cylindrical member 101 that extends across the intake manifold W, and has its ends journalled in the parallel side walls of the manifold. A control arm 111 is attached to the shaft 107 of the member 101 and FIG. 16 also shows the arm. Any linkage arrangement, not shown, may be used for actuating the arm.

Figure 9:
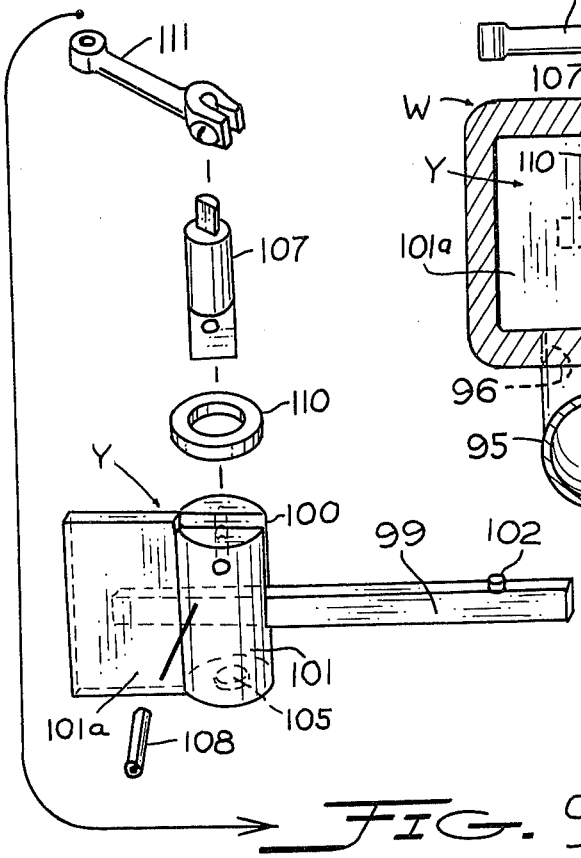
FIG. 9 is an exploded view of parts of the meter vane.

FIG. 9 illustrates the cylindrical member 101 as having a wide flat portion **101*a* that extends across the width of the manifold W, and separating the upper portion of the manifold from its lower portion, see FIGS. 6 and 8. Both the upper and lower portions of the intake manifold communicate with the intake port 97 which is narrow in width, see especially FIG. 8, and a separator bar 99 has a width equal to the width of the intake port and a length longer than that of the intake port. The separator bar 99 slides in a slot 100 which extends diametrically across the cylindrical member 101. The bar 99 has an integral projection 102 which rides in an arcuate groove 103 provided in the adjacent side wall of the intake port. The arcuate groove 103** is concentric with the longitudinal axis of the main shaft H.

Figure 17:
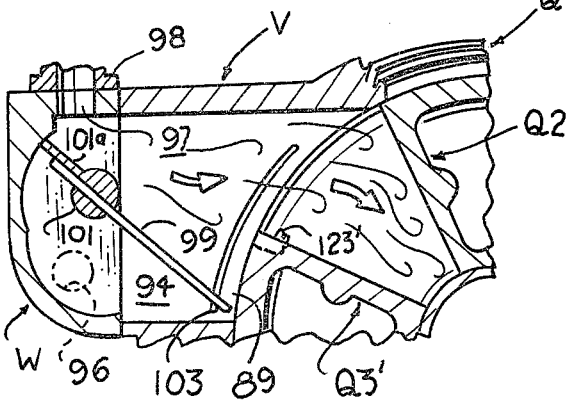
FIG. 17 is a transverse sectional view, essentially similar to portions of FIG. 6, showing the metering vane in a position for maximum power and is different from the position shown in FIG. 18.

It will be seen from FIG. 6 that as the cylindrical member 101 is rocked, the projection 102 will slide in the arcuate groove 103 and will cause the bar 99 to slide in the slot 100 so that at all positions of the bar the end of the bar disposed closest to the piston rotors will always remain at the same distance, regardless of the angle of the bar 99 in the intake passage 97. FIG. 9 illustrates the stub shaft 107 as having a flattened portion that is receivable in the adjacent end of the slot 100 and a pin 108 secures the two together. I will describe the purpose of the different angular positions of the bar 99, shown in FIGS. 17, 18 and 19 when setting forth the operation of the engine. A washer 110 is mounted adjacent to one end of the cylindrical member 101. The other end of the member 101 has an axial projection 105 received in the wall of the intake manifold W.

Figure 16:
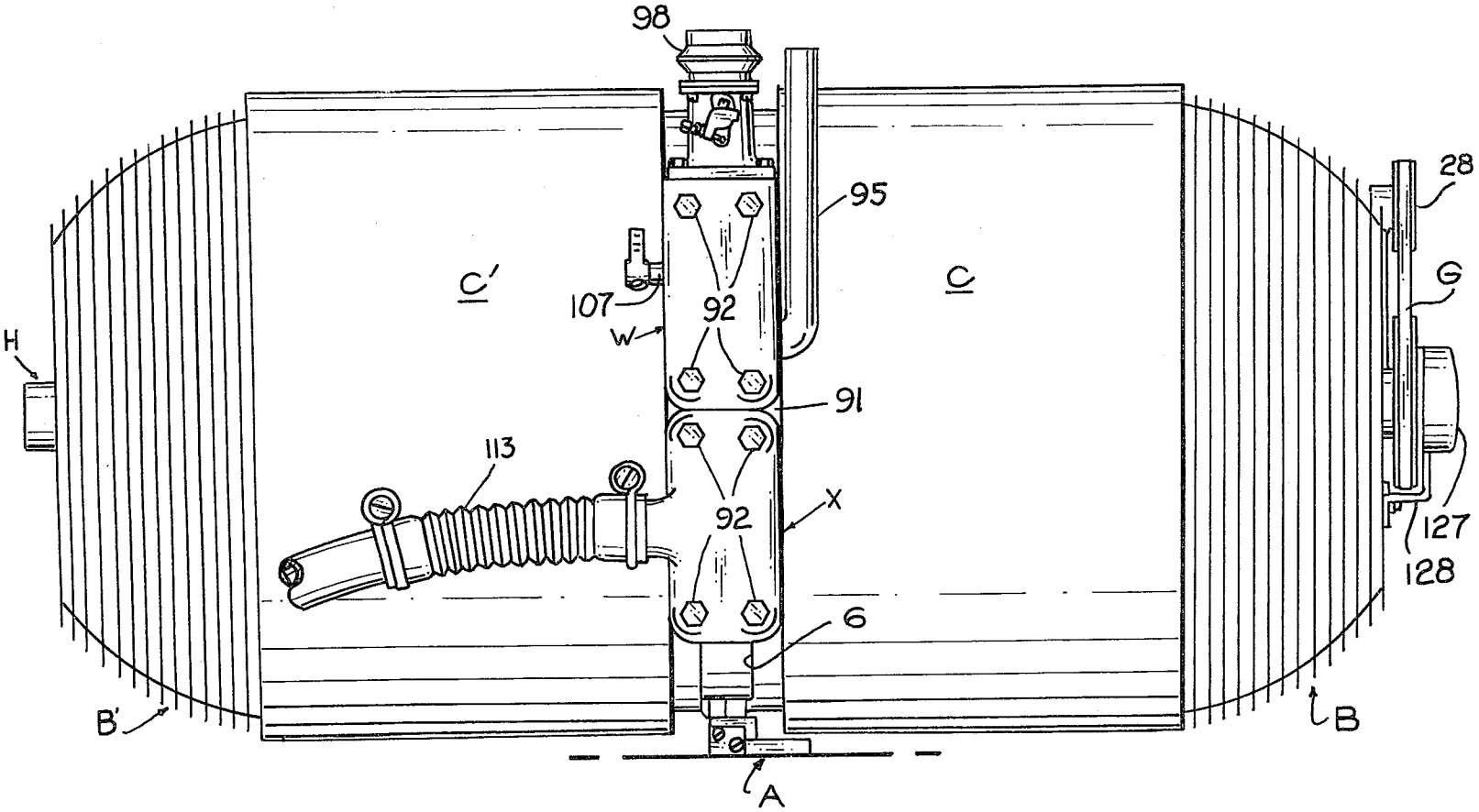
FIG. 16 is an elevational view of the right side of the engine with the front end of the engine at the right hand end of the Figure.

The exhaust port 90, see FIG. 6, communicates with the interior of an exhaust manifold X and the latter is secured in place by additional cap screws 92, see also FIG. 16. A flexible and expandible exhaust pipe 113 communicates with the exhaust manifold and conveys the exhaust gases away from the rotary engine. It is possible to rotate the port housing V through an arc for changing the angular position of the intake and exhaust ports 94 and 90 with respect to the rotating piston carrying rotors Q and Q′. Any desired means may be used for accomplishing this and I have indicated in FIG. 2, a linkage arm 112 pivoted to the lateral extension of the ring-shaped port housing V. A longitudinal movement of the linkage arm 112 in the direction of its length will rock the housing V through a desired arc in either direction. This moving of the intake and exhaust ports is equivalent to changing the cam timing on a conventional reciprocating engine. To change the cam timing either causes the valves to open earlier or later in relation to the stroke of the pistons. Certain timing settings are better for specific types of engine operation. The rotary engine will have the advantage of changing port timing during the actual operation. The advantages, depending on the need, could be efficiency, power or speed.

Referring to FIG. 7, the entire vertical forward and rear faces of port housing V encircling the axis of the engine are sealed by O rings 116 and 116'. These O rings are mounted in grooves 115 and 115' located in the vertical faces of inwardly disposed flanges 114 and 114' integral with the finned housings B and B'.

I will now set forth how the piston rotors Q and Q' with their pistons Q2 and Q3 for the piston rotor Q, and the pistons Q2' and Q3' for the piston rotor Q', respectively, although rotating in a clockwise direction, as indicated by the arrows in FIGS. 3 and 22, will be caused to slow down during part of their revolution and to speed up during another part of their revolution so that the pistons will move toward and away from each other in proper sequence to form four compartments between the adjacent ends of the pistons similar to the compartment 86. Each of the four compartments during one complete revolution of the engine will enlarge for an intake stroke of combustible gases, then will compress the gases by decreasing in size and at the height of the compression the compressed gases will be fired. This is followed by the firing "stroke" wherein the exploding gases will cause the compartment to enlarge and finally the exhaust "stroke" will take place when the compartment is again restricted in capacity for forcing the spent exhausted gases out through the exhaust port 90. By this arrangement there will be four firing "strokes" for each revolution of the rotary engine because the four compartments formed between the adjacent ends of the four pistons will be successively moved past stationary electrical contacts 126 and 126', see FIG. 3, which will close an electric circuit, not shown, to spark plugs 123 and 123', associated with the compartments, for igniting the compressed gases and producing the firing "strokes" for the compartments. Each spark 123 or 123' is mounted in a spark plug compartment 120 or 120', see FIGS. 3, 7 and 10. Within each compartment there are two fins 121 or 121' that are positioned 180° apart and are suitably attached to the outer cylindrical surface of the piston rotor Q or the piston rotor Q', see FIG. 10. The fins are slanted in such a way that the normal rotation of the engine will cause a flow of air from the fins to strike the inwardly extending annular flange 118 or 118', see FIG. 7, and to pass through the annular clearance 119 or 119' formed between the annular flange 118 or 118' and the adjacent surface of the piston rotor Q or Q'. Air can enter the spark plug compartment 120 or 120' through small entrance openings 122 or 122' in the finned housing B or B'. This air flow prevents oil from entering the spark plug compartment 120 or 120'.

FIG. 7 shows a spark plug 123 carried by the piston rotor Q with the spark creating terminals extending into a compartment formed between the two adjacent ends of opposed pistons. There will be two diametrically opposed spark plugs 123 on the piston rotor Q, and two diametrically opposed spark plugs 123' on the piston rotor Q', each spark plug being associated with its own moving compartment, similar to the compartment 86. FIG. 3 illustrates the spark plug 123' moving past the contact plate 126' and it is close enough for permitting the high voltage current in the wire 124' to cause a spark to jump across the terminals of the spark plug. The spark 123' could actually contact the plate 126' as it passes it. The contact plate 126' is insulated from the adjacent metal parts of the engine by an insulating block Z' through which the wire 124' extends as shown in FIG. 3. There is a similar insulating block Z for the forward part of the engine shown in FIG. 1.

Figure 12:
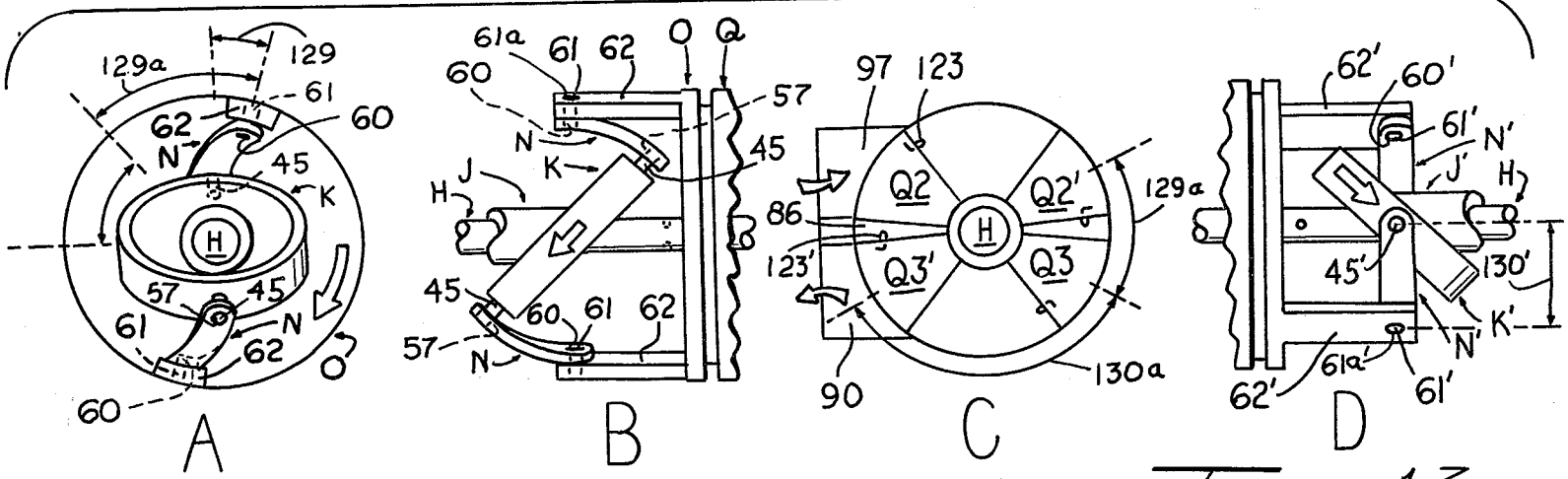
FIGS. 12, 13, 14 and 15 each show four schematic views illustrating certain parts of the rotary engine and setting forth the different positions of these parts during the operation of the engine.

FIG. 12, views A and B, diagrammatically illustrate one instantaneous position of the moving parts at the forward portion of the engine and FIG. 12, view C, indicates the relative positions of the pistons Q2 and Q3 with respect to the pistons Q2' and Q3' during this instantaneous position. As formerly stated, the pistons Q2 and Q3' form the compartment 86 which is restricted in capacity and is moving from the exhaust port 90 to the intake port 97, ready to start on its "intake stroke." The ring-shaped rotor K of FIG. 12, view A, is rotating clockwise and the radially extending rotor journals 45—45 are substantially in a vertical position, see the enlarged view of FIG. 5. The diagrammatic showing of FIG. 22 will help in visualizing the various parts where the inclined ring-shaped rotor K is shown by a ring-shaped ellipse and the diametrically opposed journals 45—45 are indicated at the top and bottom of the ellipse. The relatively short and arcuate-shaped change rods N—N extend from the journals 45—45 to the journals 61—61, see FIG. 12, view B, which are carried by the extension arms 62—62 of the rotor plate O, that in turn is connected to the piston rotor Q. It will be seen that when the parts are in this position a minimum angle, indicated at 129 in FIG. 12, view A, and shown as 16° on FIG. 22, is established between the radial axis of the diametrically opposed journals 45—45 and the radial axis of the diametrically opposed journals 61—61. Since the pair of change journals 61—61 are directly connected to the piston rotor Q and its two diametrically opposed pistons Q2 and Q3, by the pair of arms 62—62 and the rotor disc plate O, any angular change between the pairs of journals 45—45 and 61—61 will produce an angular change in the positions of the pistons Q2 and Q3 to duplicate that of the journal 61—61.

FIG. 22 shows schematically that while at the front portion of the engine (the left hand side of the Figure) there is a minimum angle shown as 16° (and 129 in FIG. 12A) as existing between the diametrically opposed pair of journals 45—45 and the diametrically opposed pair of journals 61—61 and at the same instant of time, the rear portion of the engine shows there is a maximum angle as 47.2° (and 130' in FIG. 12D) between the diametrically opposed pair of journals 45'—45' and the diametrically opposed pair of journals 61'—61'. Therefore, since the pair of journals 61'—61' are directly connected to the pistons Q2' and Q3' by the pair of diametrically opposed arms 62', the rotor disc plate O', and the piston rotor Q', the pistons Q2' and Q3' will rotate angularly about the main shaft H, in exactly the same manner as the rotor disc O', and the pair of angular change journals 61' are rotated.

Figure 13:
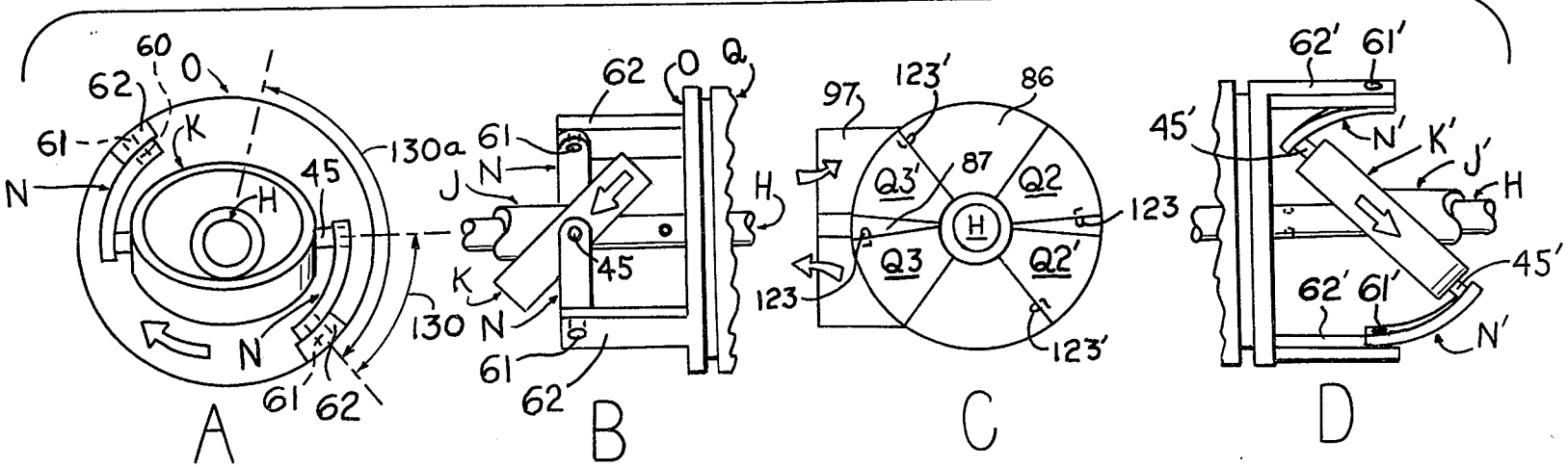

It is difficult to illustrate these relative angular changes in the pair of pistons Q2 and Q3 with respect to the pair of pistons Q2' and Q3' in the drawings, but I have endeavored to do this in the schematic FIGS. 12, 13, 14 and 15, and in the four corresponding views A, B, C and D in each of these Figures. FIG. 12, for example, in view C, shows the pistons Q2 and Q3' positioned relatively close to each other and defining a restricted space 86 that has just moved past the exhaust port 90 where the exhaust gas in the space has been forced out into the exhaust port and the restricted space 86 will be moved past the intake port 97 as the cylinders are rotated clockwise in view C, and the piston Q2 will move faster than the piston Q3' during this portion of the rotation of the pistons so as to gradually enlarge the space 86 to create a vacuum and cause combustible gases to be drawn into the space during the "intake" stroke. FIG. 13, view C, illustrates the fully expanded space 86 between the adjacent pistons Q2 and Q3' which occurs at the end of the "intake" stroke and the start of the "compression" stroke. Note that the main shaft H has rotated only through a 90° arc from the view C of FIG. 12 into the view C of FIG. 13.

Figure 14:
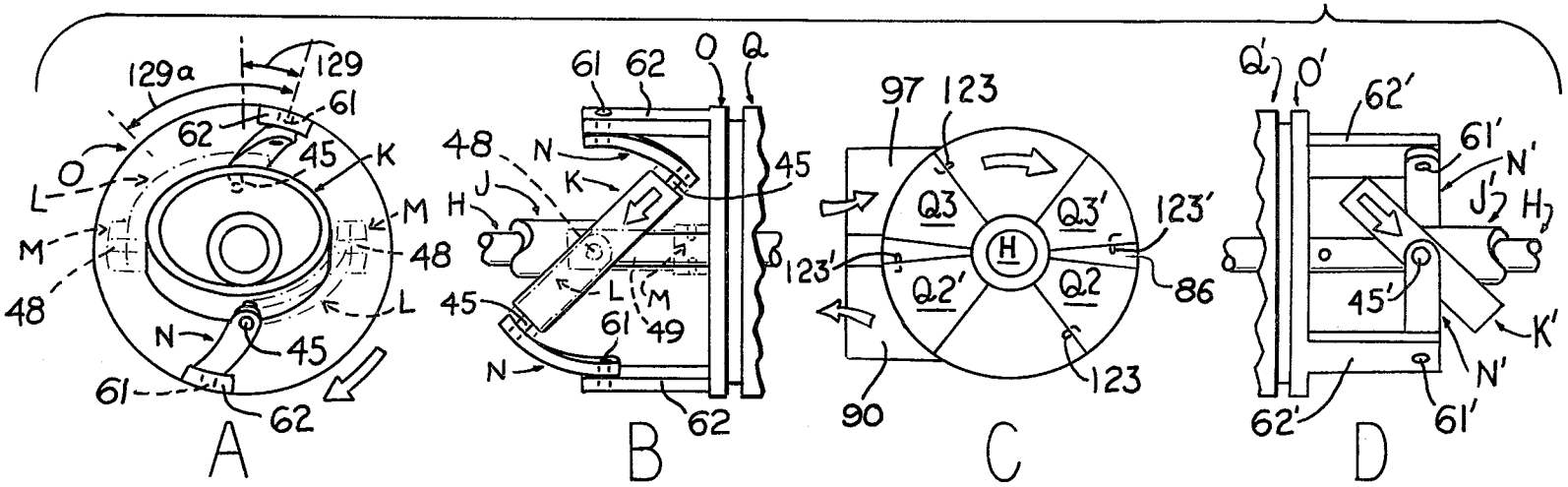
Figure 15:
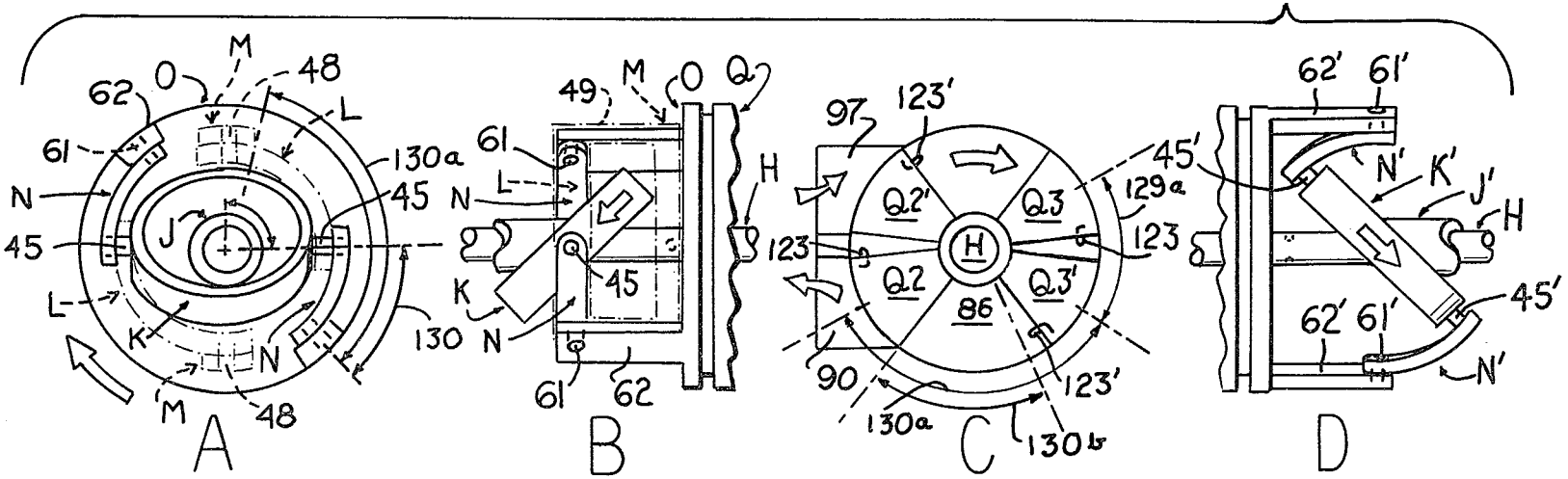

Referring to FIG. 14, the previously described actuating parts at the front of the engine, shown in views A and B of this Figure, will have moved the piston Q2 into the position shown in view C, and the actuating parts at the rear of the engine, shown in view D, will have moved the piston Q3' into the close relation with the piston Q2 as indicated in view C and the space 86 between the two pistons will be restricted. The restriction causes the compression of the combustible gases. Then in FIG. 15, views A and B show the main shaft H rotated clockwise through an additional arc of 90° from that shown in FIG. 14 and the parts illustrated in the views 15A and B have caused the piston Q2 to rotate faster than the parts in view 15D have moved the piston Q3' with the result that the space 86 between the two pistons has been enlarged.

The combustible gases are ignited by the firing device 123' at the time the enlargement of the space 86 is taking place. The sequence of strokes in the space or chamber 86 now continues again in FIG. 12 where the exhaust gases have been purged through the exhaust port 90 by the restriction of the volume between piston Q2 and Q3'.

Referring to FIG. 12C, it can be noted that four "strokes" are taking place simultaneously and continuously between the pistons Q2, Q3, Q2' and Q3'. Each charge of combustible gases proceeds through the sequence of being drawn into the engine by suction, compressing, burning and exhausting. Referring to FIG. 15C, going clockwise, the chamber between pistons Q2' and Q3 has just drawn in combustible gases. The chamber between pistons Q3 and Q3' has compressed the gases previously drawn into this chamber. In the chamber between pistons Q3' and Q2, the gases previously compressed have burned. In the chamber between pistons Q2 and Q2', the exhausting of gases previously burned, has just taken place.

I shall now describe how the power from the burning of gases is delivered to the main shaft H. The principle of delivery shall be described first and then following that the actual method will be set forth.

The way power is delivered to an output shaft of any engine can be likened to gearing. In a conventional engine the reciprocating pistons relationship with the crankshaft is one of variable ratios. Usually, gears have constant ratios, but some kinds actually have variable ratios also.

The following quantifying of forces and movements is done to show, by example, the operation of my engine, although the engine in no way should be limited in scope by such description. The quantifying will even be a greater aid in understanding the method of operation, as will be described later.

Referring again to FIG. 15C, the combustion stroke has just taken place in chamber 86 and an angle of 121.2° indicated at 130*a* is the length of total travel of the piston Q2 during the preceding stroke. The angle of 58.8° shown at 129*a* is the length of angular travel of the piston Q3' during the preceding stroke.

During the time the piston Q2 moves through the angle of 121.2° and piston Q3' moves through the angle of 58.8°, both are mechanically connected to the main-shaft. It can be seen, because of the different angular movement of each piston, the ratio to which one connects to the main shaft is different from the ratio of the other at any given moment. However, only one stroke of the engine has been described just previously during which time the main shaft W has turned 90° and the ratios between the main shaft and the pairs of pistons actually reverse for each stroke.

In a conventional reciprocating engine, the pressure caused by burning gases can be visualized at a stationary point, between the cylinder head and the piston in the cylinder. In my rotary engine the same type of pressures must be visualized from a relative standpoint. For example, the angular relative movements of the pistons while they are rotating in one direction are caused by combustion pressure, and as in a conventional reciprocating engine, the movement always is in the direction of least resistance.

In reference to the stroke indicated by FIG. 15C, the variable ratio which mechanically connects from the main shaft H to piston Q2 allows greater movement, consequently less resistance, than the ratio of the main shaft H to the piston Q3' so the clockwise rotation of the piston will be the direction of travel during this stroke.

This occurs even though the piston Q3' is also moving clockwise relative to a stationary position of the engine. The actual stroke of the engine occurs at an angle of 62.4° shown at 130*b* in FIG. 15C which is the relative movement of the piston Q2 away from the piston Q3'.

The stroke can be measured as the product of the circumference of an imaginary circle lying midway between the inner and outer cylindrical walls and concentric to the axis of the engine. The stroke in angle being 62.4° (indicated at 130*b* in FIG. 15C) the length of the stroke becomes 62.4° multiplied by a calculated circumference and divided by 360° which equals 2.723 inches, for the sake of example.

Referring to FIG. 14C, the combustible gases are being ignited in the chamber 86 by the spark plug 123' and the combustion stroke takes place which culminates in the chamber 86 of FIG. 15C. The combustion stroke has generated an average net pressure (commonly called mean effective pressure) through the stroke of a calculated 75.42 pounds per square inch. This pressure is exerted on a calculated 16.07 square inches of the Q2 piston head area for an angle of 62.4° or 2.723 inches of travel.

A 75.42 pounds per square inch of pressure exerted for 2.723 inches of stroke on 16.07 square inches of piston top area occurring at the rate of 2400 times per minute is equivalent to the power of 7,920,658.3 inch-pound per minute and dividing the power by 12 converts the quantity to foot-pound per minute and further dividing by 33,000 foot-pounds per minute the equivalent of 1 horsepower, will indicate the horsepower developed by one chamber which is 20 horsepower. And this multiplied by 4 because there are four chambers, will indicate the approximate horsepower of about 80 at 2400 RPMs. This calculation is derived from the standard expression ihp equals plan ÷ (33,000 × 12).

I will now describe the method by which the mechanical parts effect the operation. Referring to the schematic FIG. 22, I have endeavored to show some relative positions of most of the dynamic parts. I show two planes AA and AA′ intersecting the main shaft H at right angles. These two planes AA and AA′ are positioned on both sides of the rotor pistons and are arranged parallel to each other. To aid clarity, these same two planes are made square by border lines. These planes are exactly divided by vertical lines 142 and 142′ and horizontal lines 143 and 143′. The vertical and horizontal lines all intersect exactly at a point 144 exactly centered in the axis of the main shaft H.

There are two other imaginary planes shown in FIG. 22 and these are indicated at BB and BB′. These planes BB and BB′ intersect planes AA and AA′ at lines 143 and 143′, respectively. These planes BB and BB′ have lines 145 and 145′, respectively, lying flush with the planes with the upper part of each plane tipped towards the center of the engine and forming angles of 45° with the planes BB and BB′. The 45° angles are marked at the bottom of FIG. 22. The reason for arranging FIG. 22 in such a way is that all bearings for changing or transferring angular motion among the moving parts coincide with these imaginary planes. It cannot be understated that FIG. 22 resembles little of the actual parts of the engine, but it is designed to convey dynamic functions more clearly. To aid in visualization, the horizontal, vertical and inclined lines are contained completely on the square planes. The rotor pistons Q2, Q2′, Q3 and Q3′ and the main shaft H are completely encircled by an endless line 146 positioned toward the engine front and a parallel endless line 146′ positioned towards the rear of the engine. The circular line 146 represents the piston rotor Q and it has radial connections **146*a* to pistons Q2 and Q3 and longitudinal projections 62 to the pair of journals 61—61. These connections of parts are only to show that the pistons Q2 and Q3 rotate exactly as the journals 61—61. A like arrangement to the rear of the engine indicates pistons Q2′ and Q3′ rotate exactly as journals 61′—61′**, as had been previously described.

The journals 61—61 have axes which always coincide with the vertical plane AA during angular motion, the path and direction being indicated by the circular line 147 in FIG. 22. The shaft journals 48—48, likewise, have axes which always coincide with the plane AA, and the journals 48—48 rotate slightly inside the circular path of the journals 61—61, both having a common center of rotation at the point 144 at the center of the main shaft H. The parts to the rear of the engine are arranged likewise and have similar reference characters which are primed and need not be described in further detail.

The axes of the rotor journals 45—45 always coincide with the inclined plane BB, and they rotate clockwise when viewed from the engine front (as do the other journals) and have as their center of rotation the point 144 on the axis of the main shaft H. Again, by using the same reference characters to similar parts to the rear of the engine and priming them, these rear engine parts need not be described additionally.

I will now describe the method of operation. Referring to FIG. 15C, the combustible gases are compressed between the pistons Q3 and Q3′ in the normal sequence of events and the gas is ignited by the spark plug 123. The chamber that lies between the two pistons, expands from the combustion pressures and the rotation of the pistons will bring them in to the relative positions as shown in FIG. 12C. The positions of the engine parts of FIGS. 12A, B, C and D conform to those same positions as shown in the schematic showing of FIG. 22.

The angular change journals 61—61 will have the same angular velocities and forces exerted on them as the pistons Q2 and Q3 as will the journals 61′—61′ with the pistons Q2′ and Q3′. During the stroke as described between FIG. 15 and FIG. 12, an average pressure of 75.42 pounds per square inch is generated in the chamber between Q3 and Q3′. This pressure exerts a counter-clockwise force against the piston Q3 and the pins 61—61 as the piston is rotating clockwise through an arc of 58.8° against the pressure, the counter-clockwise force being 3108 inch-pounds.

The angle of 58.8° is the same as the angle **129*a* of FIGS. 12A and C. The energy generated by the piston Q3′ is a clockwise force of 6406.2 inch-pounds on the journals 61′—61′, during the angular rotation of the journals. The 121.2° is the equivalent angle 130*a* shown at FIG. 12C but in this case occurring on the rearward parts of the engine on FIG. 12D and the schematic FIG. 22**.

Referring again to FIG. 22, a novel arrangement of parts allows that as the angular change journals 61—61 and 61′—61′ rotate in the plane AA and AA′ and the rotor journals 48—48 and 48′—48′ rotate in planes BB and BB′, the paths of the journals become progressively closer and then farther apart, four times for each revolution. The angular change rods N—N and N′—N′ between the journals 45 and 61 urge the variable ratios of change also four times during each revolution between the uniformly rotating main shaft H and the pistons.

FIG. 22 describes the instant when the line 145 of plane BB coincides with the axes of the journals 45—45. The horizontal line 143, which is also the intersection of planes AA and BB, momentarily coincides with the axes of the shaft journals 48—48. The lines 143 and 145 are exactly 90° from each other indicating the transfer rods L—L are also exactly 90° from center to center of the openings receiving the journals. Looking to the rear of the engine, journals 45′—45′ are positioned at the plane intersection line 143′ and the shaft journals 48′—48′ are positioned at line 142′ of the plane AA. The lines 143′ and 142′ are exactly 90° apart indicating the transfer rod L—L and L′—L′ always hold exactly the same angles between the rotor journals 45—45 and 45′—45′ and the shaft journals 48—48 and 48′—48′. The difference between the positions of the transfer rods at both ends of the engine reflect a maximum difference in the rotation of parts, should the main shaft be altered 90° on either end the parts would line up similarly. This 90° offset relationship of the shaft coupler M and the journals 48—48 to the shaft coupler M and journals 48′—48′ is to align the controlling mechanisms so as one pair of pistons are slowing down the other pair of pistons are speeding up and vice versa.

I will now commence to describe the dynamic function by a quantifying method, as previously stated. Again referring to FIGS. 12 and 22, during the time the power stroke has occurred between the piston Q3′ and Q3 the counter-clockwise energy of piston Q3 which is 3108 inch-pounds during 58.8° (indicated at 129a in FIGS. 12A and 12C) of arc travel has transferred to the angular change journals 61—61 positioned diametrically opposite each other and coinciding with plane AA. This energy transfers to the angular change rods N—N, also disposed diametrically opposite each other, and then to the rotor journals 45—45. A change in angular velocity between the change journals 61—61 and the rotor journals 45—45 is now caused and the change rods will pivot on the journals compensating for the rotor journals rotating in the plane BB which is at a 45° angle to plane AA about which the change journals rotate. This energy to the rotor journals is 3108 inch-pounds resisting the clockwise rotation of the rotor for 90°. The energy transfers to the transfer rods L—L and to the shaft journals 48—48, through the shaft couplers M and finally to the main shaft H. It must be noted that this energy transfer takes place simultaneously with the power stroke. The energy on the shaft now is 3108 inch-pounds resisting the clockwise rotation of the main shaft H for 90°.

Observe the positions of journal 61 and the journal 45 at the top of FIG. 22. The travels of these journals can be visualized just before they reach the positions shown. The force on the rotor journal 45 from the angular change journal 61 as it is progressing up the far upper left quadrant of the plane BB will result in a counter-clockwise loading force 148 on the inclined disc of the inclined stator J. This occurs as a result of the angle of rotation in the plane BB of the journal 45 with the axis of the engine. This also is the counter-clockwise force which results from the clockwise force of a shaft as occurs in any engine.

The force occurring to the rear of the engine during the time the power stroke has occurred between the piston Q3 and piston Q3′ is 6406.2 inch-pounds in a clockwise direction for 121.2°, indicated at 130a in FIG. 12C. This energy is transferred to the angular change journals 61′—61′ positioned diametrically opposite each other and coinciding with the plane A′—A′. The energy transfers to the angular change rods N′—N′, also disposed diametrically opposite to each other, and then to the rotor journals 45′—45′. A change in the angular velocity between the journals 61′—61′ and the journals 45′—45′ is now caused as the change rods pivot on the journals, compensating for the rotation of the rotor journals 45′—45′ in the plane B′B′, as opposed to the rotation of change journals in the plane A′A′ inclined 45° thereto. The energy transferred to the rotor journals 45′—45′ is 6406.2 inch-pounds in a clockwise direction for a 90° arc. The energy transfers to the transfer rods L′—L′ and the shaft journals 48′—48′, through the shaft coupler M′ and finally to the main shaft H.

It must be noted this energy transfer takes place simultaneously with the power stroke. The energy on the shaft H to the rearward of the engine is now 6406.2 inch-pounds clockwise for a 90° arc of shaft rotation.

Observe the position of a rotor journal 45′ in FIG. 22. This rotor journal has just rotated through the upper right quadrant of plane B′B′, when the journal occupied this quadrant midway through the power stroke, it was loaded by a counter-clockwise loading force 148′ of journal 61′ and journal 48′ pulling through the change rod N′ and the transfer rod L′ and pulling towards the plane A′A′. The force 148′ is the counter-clockwise reaction of the mainshaft's clockwise action as had previously been explained for the front area of the engine.

The forces delivered to the main shaft during the power stroke between the pistons Q3′ and Q3 are 3108 inch-pounds counter-clockwise or negative power and 6406.2 inch-pounds clockwise for a 90° arc of clockwise shaft rotation. This is equivalent to 3298.2 inch-pounds positive or clockwise. This amount, as had been previously explained, is equivalent to 80 horsepower at 2400 RPMs of the shaft H.

In FIGS. 8 and 9 I have illustrated the separator bar 99 which controls the ratio of combustible mixture from the carburetor 98 and the atmospheric air from the opening 96 in the intake manifold W delivered to the chamber 86 formed between two adjacent pistons Q2 and Q3′ in FIG. 6. If no atmospheric air is desired, the separator bar 99 is swung into the position shown in FIG. 17. The control arm 111, shown in FIGS. 8 and 9, is operated for swinging the bar 99. The bar 99 in FIG. 17 has been swung to shut off the intake area 94 and prevents any atmospheric air from passing through the intake port 89, and thus charges the engine with maximum power.

Figure 18:
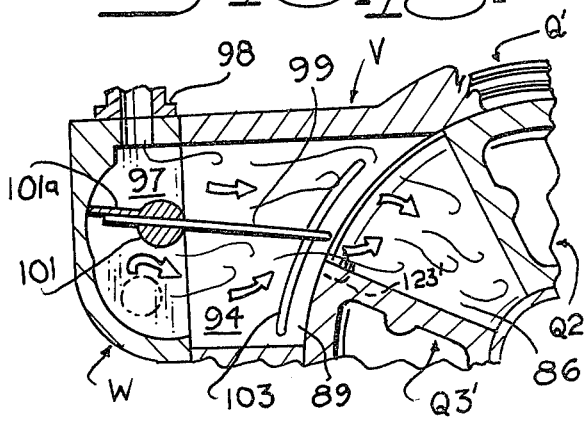
FIG. 18 is similar to FIG. 17, but shows the metering vane in a partial load position and illustrates how air enters the engine.
Figure 19:
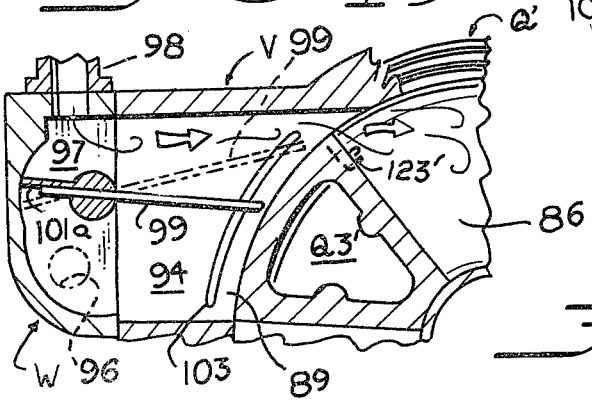
FIG. 19 is like FIG. 18 except that it indicates a further rotation of the piston rotors.
Figure 20:
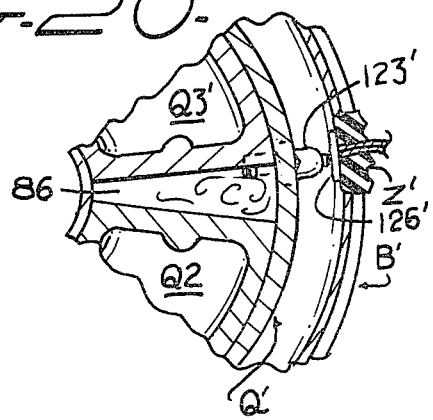
FIG. 20 is a vertical transverse section essentially to portions of FIG. 3 through a portion of two of the pistons illustrating their positions just at the moment of firing.
Figure 21:
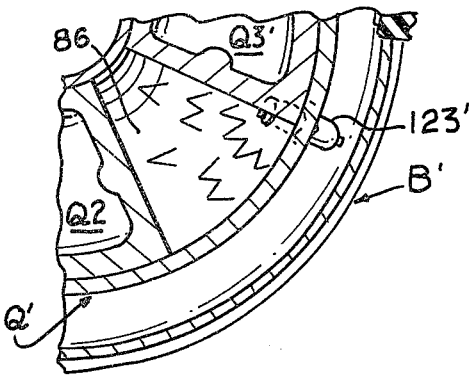
FIG. 21 shows the same two pistons when the compressed gases are exploding.

FIG. 18 illustrates the separator bar 99 swung into a position for permitting atmospheric air from the intake area 94 to mix with the combustible mixture from the carburetor 98 before entering the chamber 86 formed between the pistons Q2 and Q3′. This arrangement of the bar 99 is when the engine is under a partial load. In FIG. 19, two positions of the separator bar 99 are indicated. The upwardly inclined position (indicated by dashlines) is for the idling of the engine and the lower position is for intermediate running speed. FIG. 20 illustrates the moment of firing the compressed gases in the chamber 86 as the spark plug 123′ has its terminal pass the metal contact 126° while FIG. 21 illustrates the power stroke where the ignited gases in the chamber 86 is expanding the capacity of the chamber and is causing the piston Q2 to momentarily rotate faster than the piston Q3′, thus moving away from it.

A novel feature of my engine is illustrated in FIGS. 18 and 19. The rotation of the pistons in a clockwise direction will cause the expanding chamber 86 during the "intake stroke" to first pass the lower portion of the intake port 94 and, therefore, to receive only atmospheric air from the opening 96 in the intake manifold W. As the chamber 86 is moved in a clockwise direction, the piston Q3′ in FIG. 19, which forms one wall of the chamber, will have its outer periphery close off the fresh air inlet because this peripheral wall will have extended to the separator bar 99. The expanding chamber 86 will now only receive the combustible mixture from the port 97 and this last received mixture will overlie the fresh air in the chamber and will lie adjacent to the spark plug 123′ so as to be ignited when the spark plug is fired. The fresh air will furnish oxygen for the complete burning of the mixture during the "power stroke." The fuel separator system shown in FIGS. 17 to 21 inclusive, provides all that is needed for an effective stratified fuel charge system including metering for a lean fuel/air mixture and a richer mixture delivered adjacent to the spark plug. The separator system also allows greater evaporation time for the fuel, increasing the efficiency and reducing odor as opposed to diesel engines with fuel injection.

Again referring to FIGS. 4 and 7, the outer circular portions of the piston rotors Q and Q′ that are disposed adjacent to the rotor plates O and O′, respectively, are provided with annular grooves 117 and 117′, respectively. These annular grooves are for the purpose of preventing oil from flowing along the tops of the piston rotors Q and Q' as they rotate. The oil will be flung off at the circumferential edges of the rotor plates O and O'.

Oil is delivered to the engine by the means of an axial bore 138 in the main shaft H that runs the entire length of the shaft, see FIG. 4. Oil under pressure will enter the shaft at one end from oil line 137 into the transverse hole 137*a* of the shaft. The oil will exit from the shaft at certain points where lubrication is needed and will be directed through holes from the shaft bore to holes (not shown) in the various parts to various points where lubrication is needed. A detailed explanation of the lubrication system is not offered as the means for lubrication of rotary shafts and devices are very conventional. Oil will be directed towards the interiors of the hollow pistons and will be directed to the cooler internal areas of the finned housings B and B' through the openings 74 and 74' of the pistons, and the openings 75 and 75' of the piston rotor and 76—76' of the rotor plates, see FIG. 7. This allows circulating of the oil to cool the pistons. The oil will leave the finned housing B and B' through openings 139 and 139' located toward the opposite ends of the engine at the bottom, see FIG. 4. The oil at this time will be recirculated by a pump (not shown) and will circulate again through the shaft hole 138. The oil pump is described as being external but it could easily be integral with the engine or internally located in the engine without difficulty.

Figure 10:
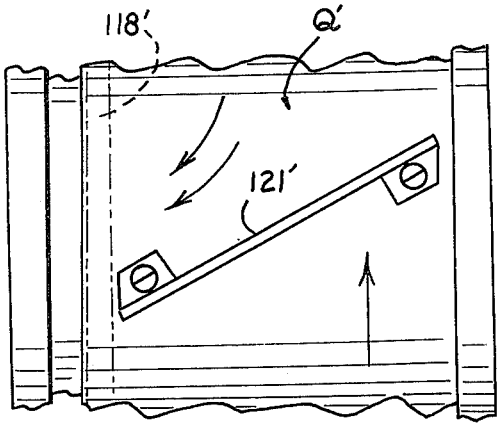
FIG. 10 is the top view of a flow fin mounted on a rotor and is taken along the line 10—10 of FIG. 3.

The four spark plugs rotate in two chambers 120 and 120' located at the outer peripheries of piston carrying rotors Q and Q', see FIGS. 6 and 10. These chambers 120 and 120' encircle the axis of the engine and are bounded by the annular flanges 118 and 118' integral with the finned housing B and B' at the outermost portions away from the ringed-shaped port housing V, of the rotors Q and Q' of which the flanges encircle. The spark plugs may be easily installed and removed through removable covers which are not shown, of the finned housing B and B'. The areas of the chambers nearest the port housing V are bounded by the integral flanges 80 and 80' of the rotors Q and Q'. The flanges 80 and 80' parallel flanges 118 and 118' and their planes are all normal to the axis of the engine. There are small additional flanges 114 and 114' encircling flanges 80 and 80' and these are integral with the finned housings B and B', as are flanges 118 and 118'. The purpose of these chambers 120 and 120' are to provide an area for the external parts of the spark plugs that seals off the sparking effect caused by contact and also the oil from the working parts of the engine. This is to prevent the spark plugs from becoming shorted. This oil may flow near the area of the flanges 118 and 118' and through the small spaces 119 and 119' between the rotor and the flanges. I provide the annular grooves 117 and 117' encircling the ends of the piston rotors so that the rotor plates O and O' may extend radially away from the rotors and causing them to act as an oil slinger to prevent the oil from entering the openings 119 and 119'. I provide a plurality of holes 122 and 122' near the insides of the chambers where air is drawn in by suction by four fins 121 and 121' which revolve with the piston rotors and are mounted thereon. The movement of these fins, one of which is clearly shown by FIG. 10, as they progress with the rotors causes the surrounding air to be swept to one side and out through the annular openings 119 and 119', thereby preventing the entry of oil through these openings. A conventional seal would not be practical at the annular openings 119 and 119' because of the high surface speeds in that area of the piston rotors near these openings.

I claim:

1. A rotary engine comprising:

(a) a cylindrical hollow housing having closed ends;

(b) a power shaft extending axially through said housing and having its ends rotatably supported by the ends of said housing;

(c) a stationary disc-shaped stator mounted near each end of said shaft and having a center bore for rotatably receiving the shaft, the two stators being inclined toward each other and the planes of said stators making a 45° angle with respect to the shaft axis;

(d) a pair of piston carrying rotors rotatably mounted on said shaft, each rotor having an annular recess with the annular recesses of the two rotors facing each other;

(e) a pair of diametrically opposed pistons mounted in each annular recess of each piston carrying rotor and having their outer ends received in the annular recess of the adjacent rotor and slidably contacting with the adjacent wall surface of the recess, the four pistons forming four compartments between adjacent pistons in the two annular recesses for receiving a combustible mixture;

(f) a ring-shaped port housing positioned between the adjacent inner ends of the piston carrying rotors and including an intake port for delivering a combustible mixture into successive compartments as said rotors and pistons rotate for causing these compartments to successively move into registration with said intake port, said ring-shaped port housing also having an exhaust port positioned so that as the compartments make substantially a complete revolution about the axis of said housing, the moving compartments will register with said exhaust port just prior to registering with said intake port;

(g) a ring-shaped rotor rotatably mounted on the circular ring of each inclined disc-shaped stator with means interconnecting said piston carrying rotors with said shaft for causing said piston carrying rotors to oscillate during their rotation for causing the two pistons of one piston carrying rotor to move toward and away from the two pistons of the other piston carrying rotor so that each successive compartment as it passes said intake port will be enlarging to receive the combustible mixture and then will be contracting for compressing the mixture;

(h) a spark plug associated with each compartment;

(i) means for firing each spark plug when its associate compartment has compressed the combustible mixture thereby causing the mixture to explode and burn for moving the two pistons forming this compartment, to relatively move away from each other for enlarging the compartment while it's still rotating about the housing axis for causing these two pistons to deliver rotative power to said shaft through said means that interconnects said piston carrying rotors with said ring-shaped rotor; and (j) said means that interconnects said piston carrying rotors with said ring-shaped rotor causing the two pistons that form the compartment that has just passed through its firing stroke, to move relatively toward each other while they rotate about the housing axis for compressing the burnt gases as the compartment means passes said exhaust port for exhausting the burnt gases through this exhaust port.

2. The combination as set forth in claim 1: and in which (a) means is associated with said inlet port for altering the mixture of combustible gas with atmospheric air for controlling the proportions of the two before they are fed into the compartments as they move past the inlet port.

3. The combination as set forth in claim 1: and in which (a) said ring-shaped port housing may be rotated angularly about the housing axis to alter the timing of the feeding of the combustible mixture from the inlet port into the chambers as they are successively moved by the inlet port.

4. The combination as set forth in claim 1: and in which (a) the inner portions of each annular recess in each piston-carrying rotor being semicircular in longitudinal section; and (b) U-shaped fluid-sealing members positioned in U-shaped fluid-sealing grooves formed in that portion of the outer surfaces of said pistons which are slidably received in the adjacent annular recess;

(c) whereby said U-shaped fluid-sealing members will slidably contact with the adjacent surface of the annular recess in which the piston is slidably received for making a fluid-tight seal therewith.

5. The combination as set forth in claim 4: and in which (a) spring means is positioned in the semicircular portions of said sealing grooves in said pistons and yieldingly forcing the semicircular portions of said U-shaped fluid-sealing members into yielding and fluid-sealing contact with the semicircular inner wall portions of the adjacent annular recess.

6. The combination as set forth in claim 1: and in which (a) said cylindrical hollow housing has a plurality of integral ring-shaped fins extending outwardly from the outer surface of said housing for cooling the housing;

(b) said housing being enclosed by two cylindrical shrouds which encircle some of the fins;

(c) said housing having a fan housing for sucking in atmospheric air and for forcing it between said shrouds and said fins for cooling the engine.

7. The combination as set forth in claim 1: and in which (a) said means for firing each spark plug includes a contact plate mounted within the interior of said housing and being insulated therefrom;

(b) the spark plugs associated with each compartment being carried by said piston-carrying rotors and having electrically conveying terminals projecting outwardly beyond said rotors traveling in a transversely extending plane that is normal to the shaft axis and also extending through said contact plate;

(c) whereby the rotation of said piston-carrying rotors will successively move said terminals into electrical contact with said plates for firing the spark plugs and exploding the combustible mixture in said compartment associated with the spark plug.

8. The combination as set forth in claim 1: and in which (a) the means interconnecting said ring-shaped rotors with said piston-carrying rotors including:

(b) a pair of diametrically opposed quadrant-shaped change rods having one of their ends pivotally connected at diametrical points on each of said ring-shaped rotors, the other ends of said change rods being pivotally secured at diametrically opposite points to a pair of extension arms, that parallel each other and parallel the shaft axis and are disposed on opposite sides thereof, the pivot points between the change rods and the extension arms lying in a plane that is normal to the shaft axis and cuts through the midpoint of the axial line for the pivotal connections between the ring-shaped rotors and the quadrant-shaped change rods;

(c) said pair of extension arms for each ring-shaped rotor being connected to said piston-carrying rotors so that they rotate as a unit;

(d) a pair of shaft couplers for each ring-shaped rotor and having one of their ends keyed to the shaft so as to rotate therewith as a unit and having their other ends pivotally connected to each ring-shaped rotor at diametrically opposite points thereon being spaced 90° from the pivotal connections of said quadrant-shaped change rods and said ring-shaped rotors;

(e) whereby a continuous rotation of said shaft in one direction will cause said inclined ring-shaped rotors to rotate on said inclined disc-shaped stators for causing said piston-carrying rotors to rotate their pistons with respect to the pistons carried by the other rotor for causing adjacent pairs of pistons, one from each rotor, to move toward and away from each other twice during one complete rotation of said shaft so that each of the four compartments formed between adjacent pairs of pistons will enlarge and contract twice to simulate the intake, compression, firing and exhaust strokes of a four cycle engine.

9. The combination as set forth in claim 3: and in which (a) the exhaust port in said ring-shaped port housing has a flexible exhaust pipe communicating therewith and communicating with a stationary exhaust pipe so as to permit the angular rotation of said ring-shaped port housing without affecting the flow of exhaust gases from the exhaust port, through the flexible exhaust pipe and the stationary exhaust pipe.

10. The combination as set forth in claim 1: and in which (a) said pistons being hollow and having air passages communicating with the interior of said housing;

(b) whereby air and oil can circulate between the piston interiors and the interior of the housing for cooling purposes.

11. The combination as set forth in claim 1: and in which (a) two spark plug containing chambers encircle the piston-carrying rotors;

(b) said chambers containing fins mounted about the rotors, the rotation of which draws air through a plurality of openings in said cylindrical housings and forces air through openings located within the said cylindrical housing forcing oil away from the spark plug containing chambers.

12. The combination as set forth in claim 1: and in which (a) said power shaft having an axial bore therein and means for feeding oil into the bore and for delivering oil from the bore to lubricate and cool the engine.

* * * * *